US011767843B2

(12) United States Patent
Jo et al.

(10) Patent No.: US 11,767,843 B2
(45) Date of Patent: Sep. 26, 2023

(54) SCROLL COMPRESSOR HAVING AN OIL SUPPLY PASSAGE INCLUDING FIRST END OPEN AT THE ORBITING SPACE AND SECOND END OPEN AT AN OLDHAM RING

(71) Applicant: LG ELECTRONICS INC., Seoul (KR)

(72) Inventors: Changeol Jo, Seoul (KR); Suchul Kim, Seoul (KR); Junghwan Jang, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 0 days.

(21) Appl. No.: 17/843,101

(22) Filed: Jun. 17, 2022

(65) Prior Publication Data

US 2023/0107145 A1 Apr. 6, 2023

(30) Foreign Application Priority Data

Sep. 17, 2021 (KR) ..... 10-2021-0125272

(51) Int. Cl.
*F03C 2/00* (2006.01)
*F03C 4/00* (2006.01)
(Continued)

(52) U.S. Cl.
CPC ..... *F04C 18/0215* (2013.01); *F01C 17/066* (2013.01); *F04C 29/028* (2013.01); *F04C 23/008* (2013.01)

(58) Field of Classification Search
CPC .... F04C 18/0215; F04C 23/008; F04C 29/02; F04C 29/023; F04C 29/025; F04C 29/028;
(Continued)

(56) References Cited

U.S. PATENT DOCUMENTS

2005/0063837 A1* 3/2005 Lee ..... F04C 29/023 417/410.5
2005/0135957 A1* 6/2005 Park ..... F04C 29/023 418/55.6
(Continued)

FOREIGN PATENT DOCUMENTS

JP 04-42201 4/1992
JP 05-240175 A * 9/1993
(Continued)

OTHER PUBLICATIONS

JP05-240175A—UKAI—Scroll Fluid Machine—Sep. 17, 1993—the Machine English Translation Abstract. (Year: 1993).*
(Continued)

*Primary Examiner* — Theresa Trieu
(74) *Attorney, Agent, or Firm* — KED & ASSOCIATES

(57) ABSTRACT

A scroll compressor may include an oil supply passage formed in a main frame. A first end of the oil supply passage may be open toward an orbiting space of the main frame and a second end may be open toward an Oldham ring. With this configuration, even if refrigerant suctioned through a refrigerant suction pipe sweeps away oil, which lubricates a sliding surface between a key and a key groove adjacent to the refrigerant suction pipe while passing through between the key and the key groove, oil may be quickly and smoothly supplied to the sliding surface. This may prevent wear between the key and the key groove so as to enhance efficiency of the compressor.

13 Claims, 16 Drawing Sheets

(51) Int. Cl.

| | |
|---|---|
| ***F04C 2/00*** | (2006.01) |
| ***F04C 29/02*** | (2006.01) |
| ***F04C 18/02*** | (2006.01) |
| ***F01C 17/06*** | (2006.01) |
| *F04C 23/00* | (2006.01) |

(58) Field of Classification Search
CPC ..... F04C 2240/60; F04C 2240/603; F04C 2240/809; F01C 1/0215; F01C 17/06; F01C 17/066
See application file for complete search history.

(56) References Cited

U.S. PATENT DOCUMENTS

2008/0008613 A1* 1/2008 Kim ..... F04C 29/023 418/55.6
2010/0050122 A1* 2/2010 Nakajima ..... F04C 18/0215 418/55.3
2010/0215536 A1* 8/2010 Kiyokawa ..... F04C 18/0253 418/55.3
2016/0298885 A1 10/2016 Doepker et al.
2017/0268511 A1* 9/2017 Imai ..... F04C 18/0215
2020/0208632 A1* 7/2020 Nagulpelli ..... F01C 17/066

FOREIGN PATENT DOCUMENTS

KR 2001109821 A * 12/2001
KR 10-0417418 2/2004
KR 10-2005-0028217 3/2005
KR 10-2005-0043485 A * 11/2005
KR 10-1043249 6/2011
KR 10-2015-0126499 11/2015
KR 102155603 B1 * 9/2020

OTHER PUBLICATIONS

KR-2001109821-A—Kim S C—Structure for Supplying Oil of Scroll Compressor—Dec. 2001—the Machine English Translation Abstract. (Year: 2001).*
KR102155603B1—Jo et al.—Scroll Compressor—Sep. 2020—the Machine English Translation. (Year: 2020).*

* cited by examiner

SCROLL COMPRESSOR HAVING AN OIL SUPPLY PASSAGE INCLUDING FIRST END OPEN AT THE ORBITING SPACE AND SECOND END OPEN AT AN OLDHAM RING

CROSS-REFERENCE TO RELATED APPLICATION(S)

Pursuant to 35 U.S.C. § 119(a), this application claims the benefit of the earlier filing date and the right of priority to Korean Patent Application No. 10-2021-0125272, filed in Korea on Sep. 17, 2021, the contents of which are incorporated by reference herein in their entirety.

BACKGROUND

1. Field

A scroll compressor, and more particularly, a scroll compressor having an Oldham ring is disclosed herein.

2. Background

Scroll compressors may be classified into a high-pressure scroll compressor and a low-pressure scroll compressor according to a refrigerant suction path. In a high-pressure scroll compressor, a refrigerant suction pipe is directly connected to a low-pressure portion defining a suction pressure chamber, so that refrigerant is directly guided to the low-pressure portion without passing through an inner space of a casing. In a low-pressure scroll compressor, an inner space of a casing is divided into a low-pressure portion defining a suction pressure chamber and a high-pressure portion defining a discharge pressure chamber by a high/low pressure separation plate or a discharge plenum that communicates with a refrigerant discharge port. A refrigerant suction pipe communicates with the low-pressure portion such that suction refrigerant of low temperature is guided into the low-pressure portion via the inner space of the casing.

In a low-pressure scroll compressor disclosed in Korean Patent Publication No. 10-2015-0126499 (hereinafter "Patent Document 1"), suction refrigerant may partially flow through the low-pressure portion and cool down a drive motor installed in the low-pressure portion, thereby improving compressor efficiency. However, in the low-pressure scroll compressor as disclosed in Patent Document 1, the suction refrigerant is increased in temperature due to contact with the drive motor and then suctioned into a compression chamber. This may increase a specific volume in the low-pressure portion, thereby causing suction loss.

In addition, in the low-pressure scroll compressor such as Patent Document 1, as an outlet of a refrigerant suction pipe is disposed adjacent to an Oldham ring, the refrigerant suctioned into the low-pressure portion of the casing through the refrigerant suction pipe may almost directly come into contact with the Oldham ring. Due to this, the refrigerant suctioned into the low-pressure portion may sweep away oil that lubricates a sliding surface of the Oldham ring, that is, a portion between a first key of the Oldham ring and a first key groove of a main frame or between a second key of the Oldham ring and a second key groove of an orbiting scroll. This may cause wear due to insufficient oil on a sliding surface between the key of the Oldham ring and the key groove facing it. In particular, the key groove of the orbiting scroll may be more severely worn when the orbiting scroll is made of a material softer than that of the Oldham ring or the key of the Oldham ring (for example, the key is made of cast iron and the orbiting scroll is made of aluminum). This may cause an unstable orbiting behavior of the orbiting scroll or leakage between compression chambers, thereby lowering compressor efficiency.

In a low-pressure scroll compressor disclosed in Patent Document 2 US Patent Publication No. US2016/0298885 A1 (hereinafter "Patent Document 2"), a suction conduit is provided in a low-pressure portion of a casing, so that refrigerant passing through a refrigerant suction pipe is directly suctioned into a compression chamber without passing through the low-pressure portion. This can prevent suction refrigerant from being heated. This can also prevent the suction refrigerant from sweeping away oil around an Oldham ring, thereby preventing wear between the Oldham ring and adjacent members.

However, in the low-pressure scroll compressor such as that disclosed in Patent Document 2, a drive motor may be overheated without smoothly coming into contact with the refrigerant suctioned into the low-pressure portion, which may lower motor efficiency, compared to the compressor of Patent Document 1. This may result in narrowing an operation region of the compressor and reducing efficiency of the compressor. In addition, the compressor of Patent Document 2 may separately need a suction conduit, which may cause an increase in manufacturing costs.

BRIEF DESCRIPTION OF THE DRAWINGS

Embodiments will be described in detail with reference to the following drawings in which like reference numerals refer to like elements, and wherein.

DETAILED DESCRIPTION

Description will now be given of a scroll compressor according to embodiments disclosed herein, with reference to the accompanying drawings. As aforementioned, scroll compressors may be classified into a high-pressure scroll compressor and a low-pressure scroll compressor according to a path along which refrigerant is suctioned. Hereinafter, a low-pressure scroll compressor in which an inner space of a casing is divided into a low-pressure portion and a high-pressure portion by a high/low pressure separation plate and a refrigerant suction pipe communicates with the low-pressure portion will be described as an example.

In addition, scroll compressors may be classified into a vertical scroll compressor in which a rotational shaft is disposed perpendicular to the ground and a horizontal scroll compressor in which a rotational shaft is disposed parallel to the ground. For example, in the vertical scroll compressor, an upper side may be defined as an opposite side to the ground and a lower side may be defined as a side facing the ground. Hereinafter, the vertical scroll compressor will be described as an example. However, embodiments may also be equally applied to the horizontal scroll compressor.

In addition, scroll compressors may be classified into a non-orbiting scroll back pressure type in which a non-orbiting scroll is pressed toward an orbiting scroll and an orbiting scroll back pressure type in which the orbiting scroll is pressed toward the non-orbiting scroll. Hereinafter, a scroll compressor according to the non-orbiting scroll back pressure type will be mainly described. However, embodiments may also be equally applied to the orbiting scroll back pressure type.

In addition, the scroll compressor may be provided with an anti-rotation mechanism for limiting rotation of the orbiting scroll. The anti-rotation mechanism may be implemented as an Oldham ring or a pin and ring. The anti-rotation mechanism may be disposed between an orbiting scroll and a main frame or between the orbiting scroll and a non-orbiting scroll. Hereinafter, an example in which the Oldham ring is disposed between the orbiting scroll and the non-orbiting scroll will be mainly described. However, this may also be similarly applied to the case where the Oldham ring is disposed between the orbiting scroll and the main frame, which will be described hereinafter in another embodiment.

Figure 1:
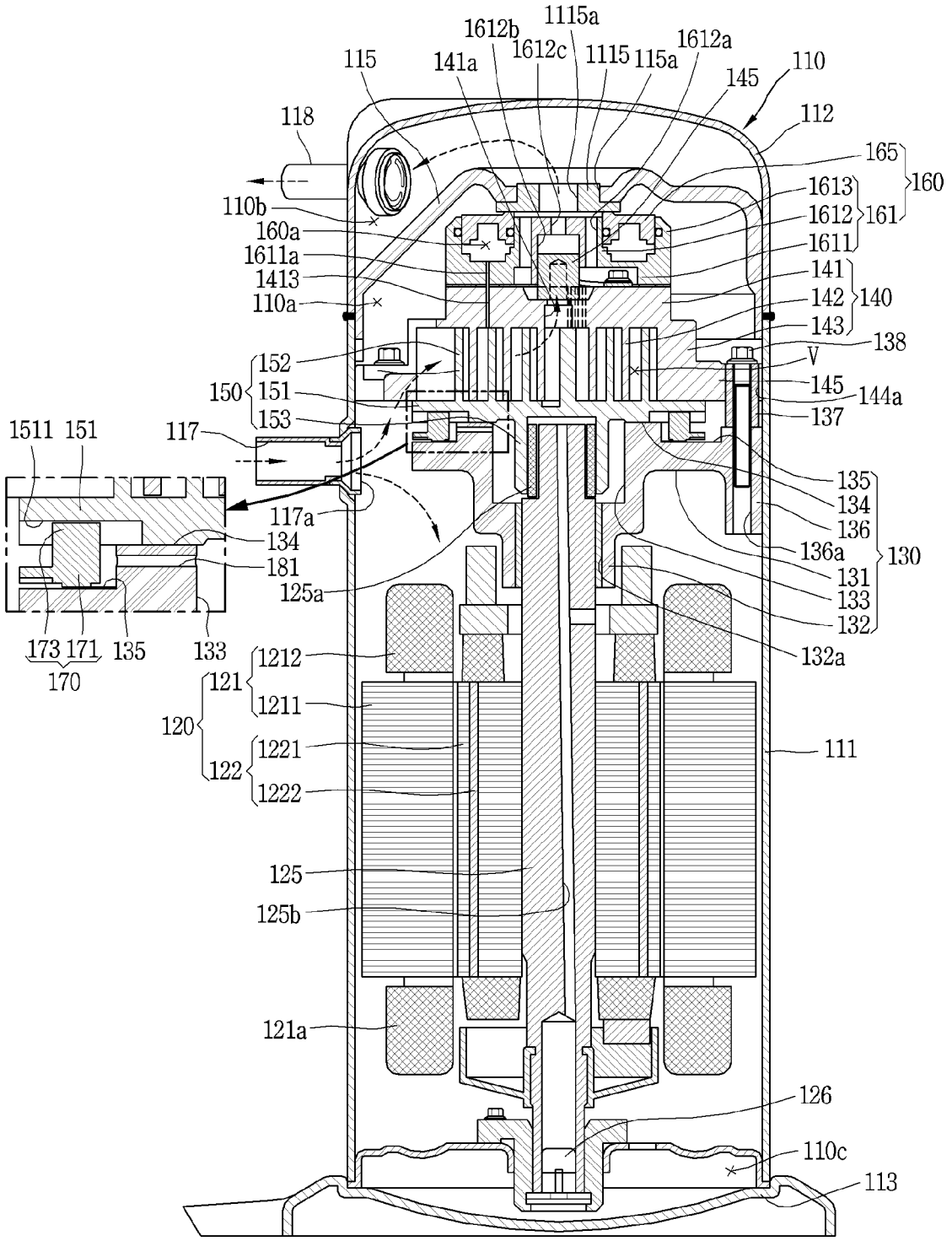
FIG. 1 is a longitudinal cross-sectional view illustrating an inner structure of a scroll compressor in accordance with an embodiment.
Figure 2:
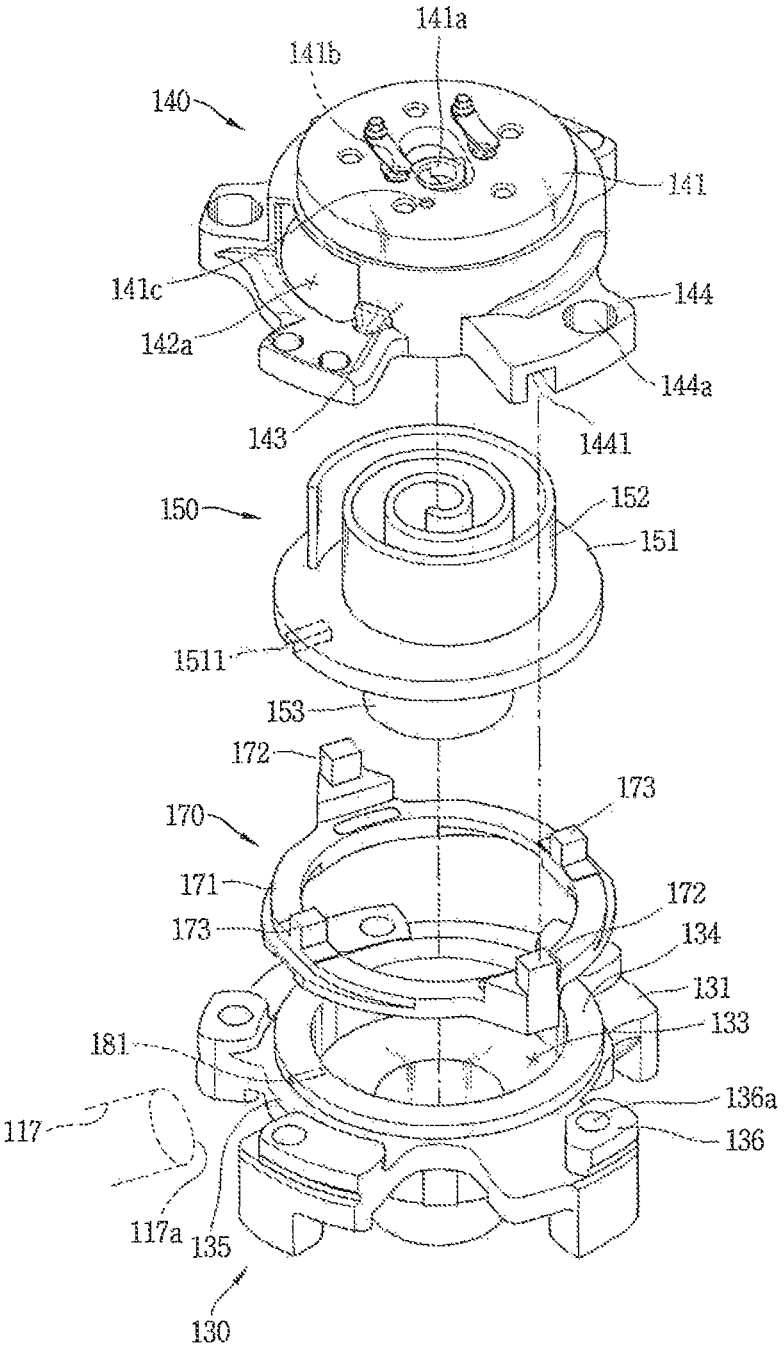
FIG. 2 is an exploded perspective view illustrating a portion of a compression unit employing a unidirectional Oldham ring in FIG. 1.
Figure 3:
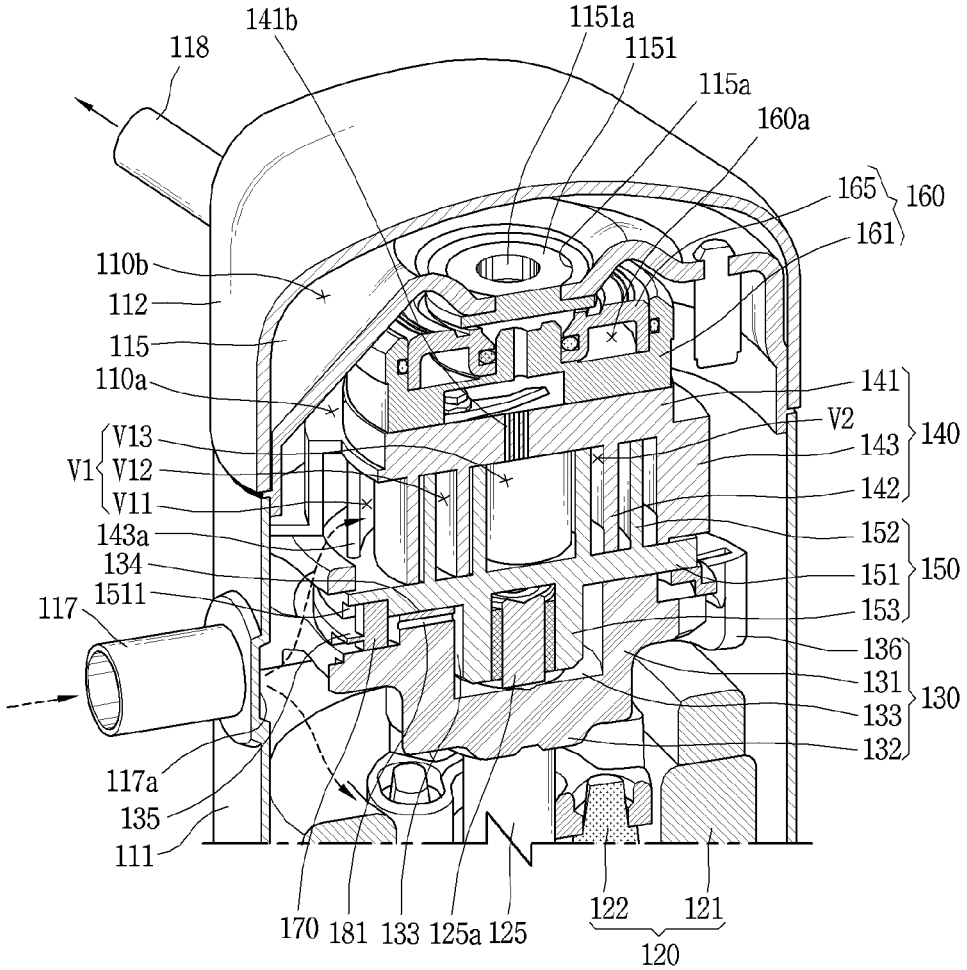
FIG. 3 is a cutout perspective view illustrating a portion of the scroll compressor of FIG. 1.

FIG. 1 is a longitudinal cross-sectional view illustrating an inner structure of a scroll compressor in accordance with an embodiment. FIG. 2 is an exploded perspective view illustrating a portion of a compression unit employing a unidirectional Oldham ring in FIG. 1. FIG. 3 is a cutout perspective view illustrating a portion of the scroll compressor of FIG. 1.

Referring to FIGS. 1 to 3, a scroll compressor according to an embodiment may include a drive motor 120 disposed in a lower half portion of a casing 110. On an upper side of the drive motor 120, a main frame 130, an orbiting scroll 150, a non-orbiting scroll 140, and a back pressure chamber assembly 160 may be sequentially disposed. In general, the drive motor 120 may constitute a motor unit, and the main frame 130, the orbiting scroll 140, the non-orbiting scroll 150, and the back pressure chamber assembly 160 may constitute a compression unit. The motor unit may be coupled to one or a first end of a rotational shaft 125, and the compression unit may be coupled to another or a second end of the rotational shaft 125. Accordingly, the compression unit may be connected to the motor unit by the rotational shaft 125 to be operated by a rotational force of the motor unit.

The casing 110 may include a cylindrical shell 111, an upper cap 112, and a lower cap 113. The cylindrical shell 111 may have a cylindrical shape with upper and lower ends open, and the drive motor 120 and the main frame 130 may be fitted on an inner circumferential surface of the cylindrical shell 111. A terminal bracket (not illustrated) may be coupled to an upper half portion of the cylindrical shell 111. A terminal (not illustrated) for that transmits external power to the drive motor 120 may be coupled through the terminal bracket. A refrigerant suction pipe 117 described hereinafter may be coupled to the upper half portion of the cylindrical shell 111, for example, above the drive motor 120.

The upper cap 112 may be coupled to cover an upper opening of the cylindrical shell 111. The lower cap 113 may be coupled to cover a lower opening of the cylindrical shell 111. A rim of a high/low pressure separation plate 115 described hereinafter may be inserted between the cylindrical shell 111 and the upper cap 112 to be, for example, welded on the cylindrical shell 111 and the upper cap 112. A rim of a support bracket 116 described hereinafter may be inserted between the cylindrical shell 111 and the lower cap 113 to be, for example, welded on the cylindrical shell 111 and the lower cap 113. Accordingly, an inner space of the casing 110 may be sealed.

The rim of the high/low pressure separation plate 115 may be, for example, welded on the casing 110 as described above. A central portion of the high/low pressure separation plate 115 may be bent and protrude toward an upper surface of the upper cap 112 so as to be disposed above the back pressure chamber assembly 160 described hereinafter. A refrigerant suction pipe 117 may communicate with a space below the high/low pressure separation plate 115, and a refrigerant discharge pipe 118 may communicate with a space above the high/low pressure separation plate 115. Accordingly, a low-pressure portion 110*a* constituting a suction space may be formed below the high/low pressure separation plate 115, and a high-pressure portion 110*b* constituting a discharge space may be formed above the high/low pressure separation plate 115.

The refrigerant suction pipe 117 may be coupled through the cylindrical shell 111 in a radial direction. An outlet 117*a* of the refrigerant suction pipe 117 may face the compression unit. For example, the outlet 117*a* of the refrigerant suction pipe 117 may be located between main flange portions or flanges 131 of the main frame 130 described hereinafter. Accordingly, some of refrigerant suctioned into the low-pressure portion 110*a* through the refrigerant suction pipe 117 may move upward to be directly suctioned into the compression chamber V, while the remaining refrigerant may move down toward the motor unit to cool down the drive motor 120 constituting the motor unit. A communication position of the refrigerant suction pipe 117 will be described hereinafter.

The refrigerant discharge pipe 118 may be coupled through the upper cap 112 in the radial direction. The outlet 117*a* of the refrigerant suction pipe 117 may be located to face an outer surface of the high/low pressure separation plate 115, more precisely, disposed between an inner circumferential surface of the upper cap 112 and an outer circumferential surface of the high/low pressure separation plate 115. Accordingly, the refrigerant passing through a high/low pressure communication hole 1115*a* of a sealing plate 1115 described hereinafter may flow along the outer circumferential surface of the high/low pressure separation plate 115 and then flow out of the compressor through the refrigerant discharge pipe 118.

In addition, a through hole 115*a* may be formed through a center of the high/low pressure separation plate 115. A sealing plate 1115 from which a floating plate 165 described hereinafter is detachable may be inserted into the through hole 115*a*. Accordingly, the low-pressure portion 110*a* and the high-pressure portion 110*b* may be blocked from or communicate with each other by attachment and detachment of the floating plate 165 and the sealing plate 1115.

The sealing plate 1115 may be formed in an annular shape. For example, the high/low pressure communication hole 1115*a* may be formed through a center of the sealing plate 1115 so that the low-pressure portion 110*a* and the high-pressure portion 110*b* communicate with each other. The floating plate 165 may be detachably coupled along a circumference of the high/low pressure communication hole 1115*a*. Accordingly, the floating plate 165 may be moved up and down axially by back pressure, so as to be detachably coupled to a circumference of the high-low pressure communication hole 1115*a* of the sealing plate 1115*a*. In this process, the low-pressure portion 110*a* and the high-pressure portion 110*b* may be sealed from or communicate with each other.

In addition, the lower cap 113 may define an oil storage space 110*c* together with the lower portion of the cylindrical shell 111 constituting the low-pressure portion 110*a*. In other words, the oil storage space 110*c* may be defined in the lower portion of the low-pressure portion 110*a*. The oil storage space 110*c* may thus define a portion of the low-pressure portion 110*a*.

Hereinafter, the drive motor will be described.

Referring to FIGS. 1 and 3, the drive motor 120 according to an embodiment may be disposed in the lower portion of the low-pressure portion 110*a* and include a stator 121 and a rotor 122. The stator 121 may be, for example, shrink-fitted onto an inner wall surface of the cylindrical shell 111. The rotor 122 may be rotatably disposed inside of the stator 121.

The stator 121 may include a stator core 1211 and a stator coil 1212. The stator core 1211 may be formed in a cylindrical shape and may be, for example, shrink-fitted onto the inner circumferential surface of the cylindrical shell 111. The stator coil 1212 may be wound around the stator core 1211 and may be electrically connected to an external power source through a terminal (not illustrated) that is coupled through the casing 110.

The rotor 122 may include a rotor core 1221 and permanent magnets 1222. The rotor core 1221 may be formed in a cylindrical shape, and may be rotatably inserted into the stator core 1211 with a predetermined gap therebetween. The permanent magnets 1222 may be embedded in the rotor core 1221 at predetermined intervals along a circumferential direction.

In addition, the rotational shaft 125 may be, for example, press-fitted to a center of the rotor core 1221. An eccentric portion 125*a* may be disposed on an upper end of the rotational shaft 125, and an orbiting scroll 150, which will be described hereinafter, may be eccentrically coupled to the eccentric portion 125*a*. Accordingly, a rotational force of the drive motor 120 may be transmitted to the orbiting scroll 150 through the rotational shaft 125.

An oil passage 125*b* may be formed through the rotational shaft 125 in an axial direction. An oil pump 126 that suctions up oil stored in the lower portion of the casing 110 may be disposed in or at a lower end of the rotational shaft 125. Accordingly, oil stored in the lower portion of the casing 110 may be suctioned along the oil passage 125*b* of the rotational shaft 125 and move toward an orbiting space portion or space 133. This oil may then be scattered by a pressure difference or by collision with a rotational shaft coupling portion, which turns in the orbiting space 133, so as to be supplied to bearing surfaces between neighboring members.

Next, the main frame will be described.

Referring to FIGS. 1 to 3, the main frame 130 according to this embodiment may be disposed above the drive motor 120 and may be, for example, shrink-fitted or welded to an inner wall surface of the cylindrical shell 111. The main frame 130 may include a main flange portion or flange 131, a main bearing portion or bearing 132, orbiting space portion or space 133, a scroll support portion or support 134, an Oldham ring support portion or support 135, and a frame fixing portion 136.

The main flange 131 may be formed in an annular shape and accommodated in the low-pressure portion 110*a* of the casing 110. An outer diameter of the main flange 131 may be smaller than an inner diameter of the cylindrical shell 111 so that an outer circumferential surface of the main flange 131 is spaced apart from an inner circumferential surface of the cylindrical shell 111. However, the frame fixing portion 136 described hereinafter may protrude from the outer circumferential surface of the main flange 131 in the radial direction. An outer circumferential surface of the frame fixing portion 136 may be fixed in close contact with the inner circumferential surface of the casing 110. Accordingly, the frame 130 may be fixedly coupled to the casing 110.

The main bearing 132 may protrude downward from a lower surface of a central portion of the main flange 131 toward the drive motor 120. A bearing hole 132*a* formed in a cylindrical shape may penetrate through the main bearing 132 in the axial direction. The rotational shaft 125 may be inserted into an inner circumferential surface of the bearing hole 132*a* and supported in the radial direction.

The orbiting space 133 may be recessed from the center portion of the main flange 131 toward the main bearing 132 to have a predetermined depth and outer diameter. The outer diameter of the orbiting space 133 may be larger than an outer diameter of a rotational shaft coupling portion 153 that is disposed on the orbiting scroll 150 described hereinafter. Accordingly, the rotational shaft coupling portion 153 may be pivotally accommodated in the orbiting space 133.

In addition, oil suctioned up through the rotational shaft 125 may be temporarily stored in the orbiting space 133. This oil may be supplied to a gap between the main bearing 132 and the rotational shaft 125 and/or a gap between the scroll support 134 and the orbiting scroll 150.

In addition, some of the oil accommodated in the orbiting space 133 may be supplied to the Oldham ring support 135 through an oil supply passage 181, 182 described hereinafter. This oil may be scattered by an Oldham ring 170 reciprocating in the Oldham ring support 135, so as to be supplied into a gap between a key 172, 173 of the Oldham ring 170 and a key groove 1441 into which the key 172, 173 of the Oldham ring 170 is inserted. The oil supply passage 181 will be described hereinafter.

The scroll support 134 may be formed in an annular shape on an upper surface of the main flange 131 along a circumference of the orbiting space 133. Accordingly, the scroll support 134 may support a lower surface of an orbiting end plate 151 described hereinafter in the axial direction.

The Oldham ring support 135 may be formed in an annular shape on an upper surface of the main flange 131 along an outer circumferential surface of the scroll support 134. Accordingly, the Oldham ring 170 may be inserted into the Oldham ring support 135 to be pivotable.

The frame fixing portion 136 may extend radially from an outer circumference of the Oldham ring support 135. The frame fixing portion 136 may extend in an annular shape or may extend to form a plurality of protrusions spaced apart from one another by predetermined intervals. This embodiment illustrates an example in which the frame fixing portion 136 has a plurality of protrusions along the circumferential direction.

For example, the plurality of frame fixing portions 136 may face guide protrusions 144 of a non-orbiting scroll 140 described hereinafter in the axial direction, respectively. Each of the frame fixing portions 136 may include a bolt coupling hole 136*a* formed therethrough in the axial direction to correspond to a guide insertion hole 144*a* described hereinafter in the axial direction.

An inner diameter of the bolt coupling hole 136*a* may be smaller than an inner diameter of the guide insertion hole 144*a*. Accordingly, a stepped surface that extends from an inner circumferential surface of the guide insertion hole 144*a* may be formed around an upper surface of the bolt coupling hole 136*a*. A guide bush 137 that is inserted through the guide insertion hole 144*a* may be placed on this stepped surface so as to be supported on the frame fixing portion 136 in the axial direction.

The guide bush 137 may be formed in a hollow cylindrical shape through which a bolt insertion hole 137*a* is formed in the axial direction. A guide bolt 138 may be inserted through the bolt insertion hole 137*a* of the guide bush 137 to be coupled to the bolt coupling hole 136*a* of the frame fixing portion 136. The non-orbiting scroll 140 may thus be slidably supported on the main frame 130 in the axial direction and fixed to the main frame 130 in the radial direction.

On the other hand, the frame fixing portions 136 may be formed at predetermined intervals along the circumferential direction, and a kind of suction guide space (no reference numeral given) may be defined between the frame fixing portions 136 facing each other in the circumferential direction. As described above, the outlet 117*a* of the refrigerant suction pipe 117 may be radially accommodated in the suction guide space in the radial direction. Accordingly, refrigerant suctioned into the low-pressure portion 110*a* through the refrigerant suction pipe 117 may be separated while passing through the suction guide space, so that some moves to the compression chamber V and the rest moves toward the drive motor 120.

Hereinafter, the non-orbiting scroll will be described.

Referring to FIGS. 1 to 3, the non-orbiting scroll 140 according to this embodiment may be disposed on an upper portion of the main frame 130 with interposing the orbiting scroll 150 therebetween. The non-orbiting scroll 140 may be fixedly coupled to the main frame 130 or may be coupled to the main frame 130 to be movable up and down. This embodiment illustrates an example in which the non-orbiting scroll 140 is coupled to the main frame 130 to be movable relative to the main frame 130 in the axial direction.

The non-orbiting scroll 140 according to this embodiment may include a non-orbiting end plate 141, a non-orbiting wrap 142, a non-orbiting side wall portion 143, and a guide protrusion 144. The non-orbiting end plate 141 may be formed in a disk shape and disposed in a horizontal direction in the low-pressure portion 110*a* of the casing 110. A discharge port 141*a*, a bypass hole 141*b*, and a scroll-side back pressure hole 141*c* may be formed through a central portion of the non-orbiting end plate 141 in the axial direction.

The discharge port 141*a* may be located at a position at which a discharge pressure chamber (no reference numeral given) of a first compression chamber V1 and a discharge pressure chamber (no reference numeral given) of a second compression chamber V2 communicate with each other. The bypass hole 141*b* may communicate with the first compression chamber V1 and the second compression chamber V2. The scroll-side back pressure hole (hereinafter, referred to as a "first back pressure hole") 141*c* may be spaced apart from the discharge port 141*a* and the bypass hole 141*b*.

The non-orbiting wrap 142 may extend from a lower surface of the non-orbiting end plate 141 facing the orbiting scroll 150 by a predetermined height in the axial direction. The non-orbiting wrap 142 may extend to be spirally rolled a plurality of times toward the non-orbiting side wall portion 143 around the outlet 117*a*. The non-orbiting wrap 142 may correspond to an orbiting wrap 152 described hereinafter, so as to define a pair of compression chambers V1 and V2 with the orbiting wrap 152.

The non-orbiting side wall portion 143 may extend in an annular shape from an edge of a lower surface of the non-orbiting end plate 141 in the axial direction. A suction port 143*a* may be formed through one side of an outer circumferential surface of the non-orbiting side wall portion 143 in the radial direction.

For example, the suction port 143*a* may be formed in an arcuate shape that extends by a predetermined length between a plurality of guide protrusions 144 described hereinafter in the circumferential direction. Accordingly, refrigerant suctioned through the refrigerant suction pipe 117 may be rapidly suctioned into the suction port 143*a* via the guide protrusions 144.

The guide protrusion 144 may extend radially from an outer circumferential surface of a lower side of the non-orbiting side wall portion 143. The guide protrusion 144 may be a single annular shape or may include a plurality of guide protrusions 144 disposed at preset or predetermined intervals in the circumferential direction. This embodiment will be mainly described with respect to an example in which the plurality of guide protrusions 144 is disposed at preset or predetermined intervals along the circumferential direction.

Guide insertion holes 144*a* may be formed through the plurality of guide protrusions 144, respectively, in the axial direction. Each guide insertion hole 144*a* may be flush with the bolt coupling hole 136*a* formed through the frame fixing portion 136 of the main frame 130. Accordingly, the guide bush 137 may be inserted through the guide insertion hole 144*a* to be supported on the upper surface of the frame fixing portion 136 in the axial direction.

On the other hand, some of the plurality of guide protrusions 144 may include first key grooves 1441 into which first keys 172 of the Oldham ring 170 described hereinafter are slidably inserted in the radial direction, respectively. For example, the first key grooves 1441 may be formed in two of the guide protrusions 144 that are disposed at opposite sides in the circumferential direction. Accordingly, the two first key grooves 1441 may be disposed with a phase difference of approximately 180° along the circumferential direction.

Each of the first key grooves 1441 may radially extend in a semicircular shape with an outer circumferential side open and an inner circumferential side closed. Accordingly, some oil stored in the Oldham ring support portion 135 may be introduced into the outer circumferential side of the first key groove 1441 that is partially open, so as to lubricate a gap between the first key groove 1441 and the first key 172.

Hereinafter, the orbiting scroll will be described.

Referring to FIGS. 1 to 3, the orbiting scroll 150 according to an embodiment may be disposed on an upper surface of the main frame 130 and coupled to the rotational shaft 125. For example, the orbiting scroll 150 may be disposed between the main frame 130 and the non-orbiting scroll 140. The Oldham ring 170, which is an anti-rotation mechanism, may be disposed between the orbiting scroll 130 and the main frame 130. Accordingly, the orbiting scroll 150 may perform an orbiting motion relative to the non-orbiting scroll 140 while its rotational motion is restricted.

The orbiting scroll 150 may include an orbiting end plate 151, an orbiting wrap 152, and rotational shaft coupling portion 153. The orbiting end plate 151 may be formed approximately in a disk shape. The orbiting end plate 151 may be supported on the scroll support 134 of the main frame 130 in the axial direction. Accordingly, the orbiting end plate 151 and the scroll support 134 facing it may define an axial bearing surface 1341.

Second key grooves 1511, into which second keys 173 of the Oldham ring 170 described hereinafter are slidably inserted, may be formed in a lower surface of the orbiting end plate 151. The second key grooves 1511 may be disposed with a phase difference of 180° in the circumferential direction, like the first key grooves 1441 described above, and may be disposed with a phase difference of about 90° from the first key grooves 1441 along the circumferential direction.

In addition, the second key groove 1511 may be formed in a semicircular shape with an outer circumferential side open and an inner circumferential side closed. A second end 1822 of a second oil supply passage 182 that communicates with the orbiting space 133 may penetrate through the inner circumferential side, namely, a radial inner surface 1511*a* of a second key groove 1511, which is adjacent to the refrigerant suction pipe 117, of the second key grooves 1511. This will be described hereinafter with respect to another embodiment.

The orbiting wrap 152 may be formed in a spiral shape that protrudes from an upper surface of the orbiting end plate 151 facing the non-orbiting scroll 140 to a preset or predetermined height. The orbiting wrap 152 may be formed to correspond to the non-orbiting wrap 142 to perform an orbiting motion by being engaged with the non-orbiting wrap 142 of the non-orbiting scroll 140 described hereinafter. The orbiting wrap 152 may define a compression chamber V together with the non-orbiting wrap 142.

The compression chamber V may include a first compression chamber V1 and a second compression chamber V2 based on the non-orbiting wrap 142 described hereinafter. The first compression chamber V1 may be formed at an outer surface of the non-orbiting wrap 152, and the second compression chamber V2 may be formed at an inner surface of the non-orbiting wrap 152. Each of the first compression chamber V1 and the second compression chamber V2 may include a suction pressure chamber V11 (not illustrated), an intermediate pressure chamber V12 (not illustrated), and a discharge pressure chamber V13 (not illustrated) which are continuously formed.

The rotational shaft coupling portion 153 may protrude from a lower surface of the orbiting end plate 151 toward the main frame 130. The rotational shaft coupling portion 153 may be formed in a cylindrical shape. The eccentric portion 125*a* of the rotational shaft 125 may be rotatably fitted onto an inner circumferential surface of the rotational shaft coupling portion 153. Accordingly, rotational force of the drive motor 120 may be transmitted to the rotational shaft coupling portion 153 through the eccentric portion 125*a* of the rotational shaft 125, and the rotational force transmitted to the rotational shaft coupling portion 153 may be restricted by the Oldham ring 170 such that the orbiting scroll 150 may perform an orbiting motion.

Next, the back pressure chamber assembly will be described.

Referring to FIGS. 1 to 3, the back pressure chamber assembly 160 according to an embodiment may be disposed at an upper side of the non-orbiting scroll 140. Accordingly, back pressure of a back pressure chamber 160*a* (to be precise, a force applied on the back pressure chamber) may be applied to the non-orbiting scroll 140. In other words, the non-orbiting scroll 140 may be pressed toward the orbiting scroll 150 by the back pressure to seal the compression chamber V.

The back pressure chamber assembly 160 may include a back pressure plate 161 and a floating plate 165. The back pressure plate 161 may be coupled to an upper surface of the non-orbiting end plate 141. The floating plate 165 may be slidably coupled to the back pressure plate 161 to define the back pressure chamber 160*a* together with the back pressure plate 161.

The back pressure plate 161 may include a fixed plate portion or plate 1611, a first annular wall portion or wall 1612, and a second annular wall portion or wall 1613. The fixed plate 1611 may be formed in the form of an annular plate with a hollow center. A plate-side back pressure hole (hereinafter, referred to as a "second back pressure hole") 1611*a* may be formed through the fixed plate 1611. The second back pressure hole 1611*a* may communicate with the first back pressure hole 141*c* so as to communicate with the back pressure chamber 160*a*. Accordingly, the compression chamber V and the back pressure chamber may communicate with each other through the second back pressure hole 1611*a* together with the first back pressure hole 141*c*.

The first annular wall 1612 and the second annular wall 1613 may be formed on an upper surface of the fixed plate 1611 to surround inner and outer circumferential surfaces of the fixed plate 1611. Accordingly, the back pressure chamber 160*a* formed in the annular shape may be defined by an outer circumferential surface of the first annular wall 1612, an inner circumferential surface of the second annular wall 1613, the upper surface of the fixed plate 1611, and a lower surface of the floating plate 165.

The first annular wall 1612 may include an intermediate discharge port 1612*a* that communicates with the discharge port 141*a* of the non-orbiting scroll 140. A valve guide groove 1612*b* into which a check valve (hereinafter, referred to as a "discharge valve") 145 is slidably inserted may be formed at an inner side of the intermediate discharge port 1612*a*. A backflow prevention hole 1612*c* may be formed in a center of the valve guide groove 1612*b*. Accordingly, the check valve 145 may be selectively opened and closed between the discharge port 141*a* and the intermediate discharge port 1612*a* to prevent a discharged refrigerant from flowing back into the compression chamber.

The floating plate 165 may be formed in an annular shape. The back pressure plate 161 may be formed of a light material. Accordingly, the floating plate 165 may be detachably coupled to a lower surface of the high/low pressure separation plate 115 while moving in the axial direction with respect to the back pressure plate 161 depending on the pressure of the back pressure chamber 160*a*. For example, when the floating plate 165 is brought into contact with the high/low pressure separation plate 115, the floating plate 165 may serve to seal the low-pressure portion 110*a* such that the discharged refrigerant is discharged to the high-pressure portion 110*b* without leaking into the low-pressure portion 110*a*.

Hereinafter, the Oldham ring will be described.

Referring to FIG. 2, the Oldham ring 170 according to an embodiment may be disposed between the main frame 130 and the orbiting scroll 150. As described above, the Oldham ring 170 may be slidably coupled to each of the main frame 130 and the orbiting scroll 140 or slidably coupled to each of the non-orbiting scroll 140 and the orbiting scroll 150. In this embodiment, an example of employing a unidirectional Oldham ring that is slidably coupled to the non-orbiting scroll 140 and the orbiting scroll 150 will first be described.

The Oldham ring 170 according to this embodiment may include a ring body 171, a first key 172, and a second key 173. The ring body 171 may be formed as a single body with the first key 172 and the second key 173 or the first key 172 and the second key 173 may be post-assembled to the ring body 171. In this embodiment, an example in which the ring body 171 is formed integrally with the first key 172 and the second key 173 will be mainly described. However, embodiments may be similarly applied even when the ring body 171 is post-assembled to the first key 172 and the second key 173.

The ring body 171 may have an annular shape and may be formed of an aluminum material, for example. This may reduce a weight of the Oldham ring 170 and a lower centrifugal force of a rotating body including the Oldham ring 170. In this way, a motor load of the drive motor 120 may be reduced, thereby enhancing performance of the compressor.

The first key 172 may protrude toward the non-orbiting scroll 140 from one axial side surface, for example, an upper surface, of the ring body 171 in the axial direction. The first key 172 may be slidably inserted into the first key groove 1441 of the non-orbiting scroll 140, and may be formed of a material different from a material of the non-orbiting scroll 140 made of cast iron.

In addition, the first key 172 may be formed in a rectangular parallelepiped shape extending in the radial direction to correspond to the first key groove 1441. For example, a radial length of the first key 172 may be shorter than or equal to a radial length of the first key groove 1441, and a widthwise length of the first key 172 may be shorter than a widthwise length of the first key groove 1441. Accordingly, the first key 172 may slide in the first key groove 1441 in the radial direction but may be prevented from rotating in the first key groove 1441.

The second key 173 may protrude toward the orbiting scroll 150 in the same direction as the first key 172, namely, from the one side surface, for example, the upper surface, of the ring body 171 in the axial direction. Accordingly, the Oldham ring 170 according to this embodiment may be configured as a unidirectional Oldham ring.

The second key 173 may be slidably inserted into the second key groove 1511 of the orbiting scroll 150, and may be formed of a material different from a material of the orbiting scroll 150 made of cast iron. However, when the orbiting scroll 150 is formed of an aluminum material, the second key 173 may also be formed of a material having wear resistance, such as cast iron, for example. In this case, the second key 173 may be post-assembled to the ring body 171 or coated with a wear-resistant material.

In addition, the second key 173 may be formed in a rectangular parallelepiped shape extending in the radial direction to correspond to the second key groove 1511. For example, a radial length of the second key 173 may be shorter than or equal to a radial length of the second key groove 1511, and a widthwise length of the second key 173 may be shorter than a widthwise length of the second key groove 1511. Accordingly, the second key 173 may slide in the second key groove 1511 in the radial direction but may be prevented from rotating in the second key groove 1511.

The scroll compressor according to this embodiment may operate as follows.

When power is applied to the stator coil 121*a* of the stator 121, the rotor 122 may rotate together with the rotational shaft 125. The orbiting scroll 150 coupled to the rotational shaft 125 may perform the orbiting motion with respect to the non-orbiting scroll 140, thereby forming a pair of compression chambers V between the orbiting wrap 152 and the non-orbiting wrap 142.

The compression chamber V may gradually decrease in volume while moving from outside to inside according to the orbiting motion of the orbiting scroll 150. At this time, the refrigerant may be suctioned into the low-pressure portion 110*a* of the casing 110 through the refrigerant suction pipe 117. Some of this refrigerant may be suctioned directly into the suction pressure chambers V11 (no reference numerals given) of the first compression chamber V1 and the second compression chamber V2, respectively, while the remaining refrigerant may first flow toward the drive motor 120 and then be suctioned into the suction pressure chambers V11.

The refrigerant suctioned into each suction pressure chamber V11 may be compressed while moving toward the intermediate pressure chamber V12 and the discharge pressure chamber V13 along a movement path of the compression chamber V. A portion of the refrigerant compressed while passing through the intermediate pressure chamber V12 may be bypassed in advance toward the high-pressure portion 110*b* from the intermediate pressure chamber V12 defining each compression chamber V1, V2 through the bypass hole 141*b* before reaching the discharge port 141*a*. This may prevent the refrigerant from being over-compressed over a preset or predetermined pressure or more in the compression chamber.

In addition, another portion of the refrigerant compressed while passing through the intermediate pressure chamber V12 may also move to the back pressure chamber 160*a* through the first back pressure hole 141*c* before reaching the discharge port 141*a*, so that intermediate pressure may be formed in the back pressure chamber 160*a*. Then, the floating plate 165 may move up toward the high/low pressure separation plate 115 to be in close contact with the sealing plate 1115 disposed on the high/low pressure separation plate 115. The back pressure plate 161 may accordingly be moved down by pressure, which is applied toward the non-orbiting scroll 140 by the pressure of the back pressure chamber 160*a*, thereby pressing the non-orbiting scroll 140 toward the orbiting scroll 150.

As the floating plate 165 moves up and comes in close contact with the sealing plate 1115, the high-pressure portion 110*b* of the casing 110 may be separated from the low-pressure portion 110*a*, so as to prevent the refrigerant discharged from each compression chamber V1 and V2 to the high-pressure portion 110*b* from flowing back into the low-pressure portion 110*a*. On the other hand, as the back pressure plate 161 is moved down toward the non-orbiting scroll 140, the non-orbiting scroll 140 may be brought into close contact with the orbiting scroll 150. This may prevent the compressed refrigerant from leaking into a low-pressure side compression chamber from a high-pressure side compression chamber forming the intermediate pressure chamber.

The refrigerant moved to the discharge pressure chamber V13 may then be discharged to the high-pressure portion 110*b* through the discharge port 141*a* and the intermediate discharge port 1612*a* while pushing the discharge valve 145. The refrigerant may be filled in the high-pressure portion 110*b* and then discharged through a condenser of a refrigeration cycle via the refrigerant discharge pipe 118. The series of processes may be repetitively carried out.

On the other hand, when the rotational shaft 125 rotates as described above, oil pumped by the oil pump 126 may be suctioned upward through the oil passage 125*b* and filled in the orbiting space 133. The oil may be scattered by a pressure difference and/or by collision with the rotational shaft coupling portion 153 that pivots in the orbiting space 133. Some of this oil may flow to the Oldham ring support 135 through a gap between the scroll support 134 and the orbiting scroll 150, which is generated while the orbiting scroll 150 performs an orbiting motion. The oil may then be scattered again by the Oldham ring 170, which reciprocates in the Oldham ring support 135, so as to flow to a first sliding surface S1 between the first key groove 1441 and the first key 172 or a second sliding surface S2 between the second key groove 1511 and the second key 173, thereby lubricating each sliding surface.

However, oil shortage may occur on the sliding surface (especially, the second sliding surface) between the key 172, 173 (especially, the second key) and the key groove 1441, 1511 (especially, the second key groove) which are adjacent to the outlet 117*a* of the refrigerant suction pipe 117, among the keys of the Oldham ring 170 and the key grooves 1441 and 1511 into which these keys 172 and 173 are inserted. In other words, the refrigerant suctioned into the low-pressure portion 110*a* through the refrigerant suction pipe 117 may sweep away oil remaining on the sliding surface S1 while flowing along the sliding surface S1, S2 between the key 172, 173 and the key groove 1441, 1511 which are located adjacent to the outlet 117*a* of the refrigerant suction pipe 117. This may cause oil shortage on the sliding surface S1, S2 between the key 172, 173 and the key groove 1441, 1511 which are located adjacent to the outlet 117*a* of the refrigerant suction pipe 117, thereby cause friction loss or wear on the sliding surface S1, S2 due to the oil shortage.

As a result, the orbiting behavior of the orbiting scroll 150, which receives force in a rotational direction through the Oldham ring 170, may become unstable. This may cause the friction loss between the non-orbiting scroll 140 and the orbiting scroll 150 or leakage between the compression chambers, thereby lowering efficiency of the compressor. In particular, when the Oldham ring 170 or the key of the Oldham ring 170 is formed of aluminum and the orbiting scroll 150 is formed of cast iron, the wear of the Oldham ring 170 may be more serious.

Accordingly, in this embodiment, the oil supply passage 181, 182 may be formed in the main frame 130 and/or the orbiting scroll 150 to be adjacent to or communicate with the key 172, 173 and/or the key groove 1441, 1511, such that oil may be continuously supplied forcibly to the sliding surface S1, S2 between the key 172, 173 and the key groove 1441, 1511, thereby securing an appropriate amount of oil supplied.

The oil supply passage 181, 182 according to this embodiment may be formed only in the main frame 130, only in the orbiting scroll 150, or in both of the main frame 130 and the orbiting scroll 150. Hereinafter, an oil supply passage formed in the main frame 130 may be defined as first oil supply passage 181 and an oil supply passage formed in the orbiting scroll 150 may be defined as second oil supply passage. An example in which the first oil supply passage 181 is formed in the main frame 130 will be described first.

Figure 4:
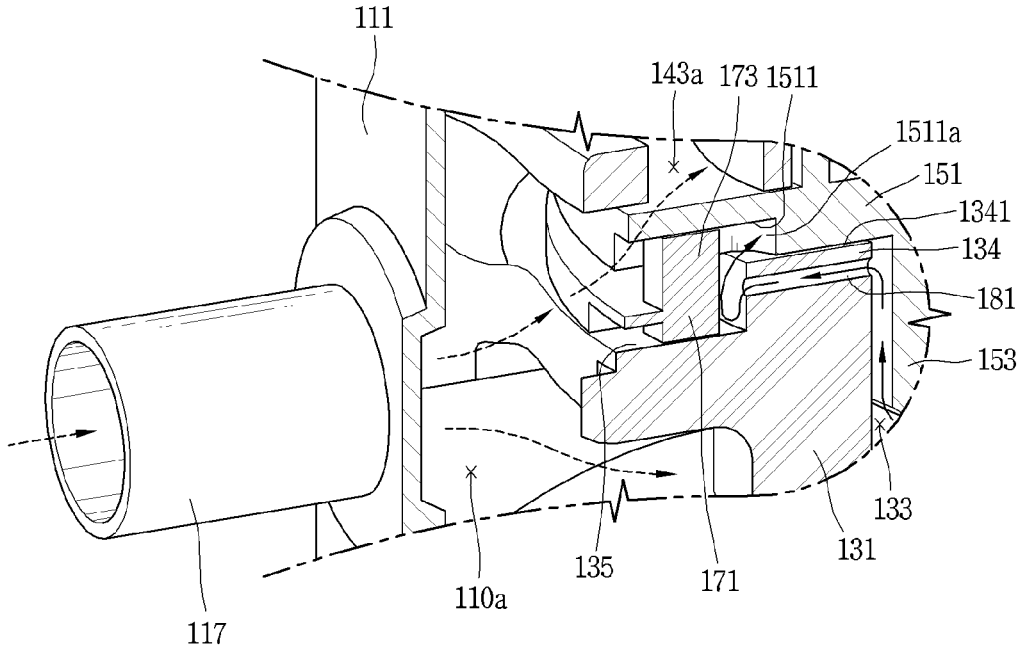
FIG. 4 is an enlarged perspective view illustrating a surrounding of an oil supply passage in FIG. 3.
Figure 5:
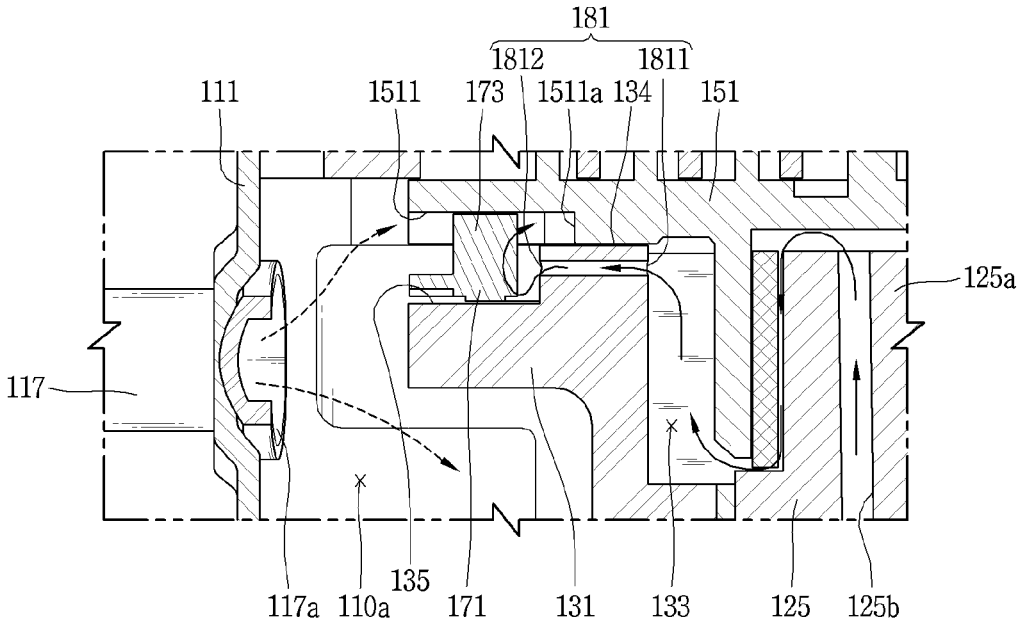
FIG. 5 is an enlarged cross-sectional view illustrating the surrounding of the oil supply passage in FIG. 3.
Figure 6:
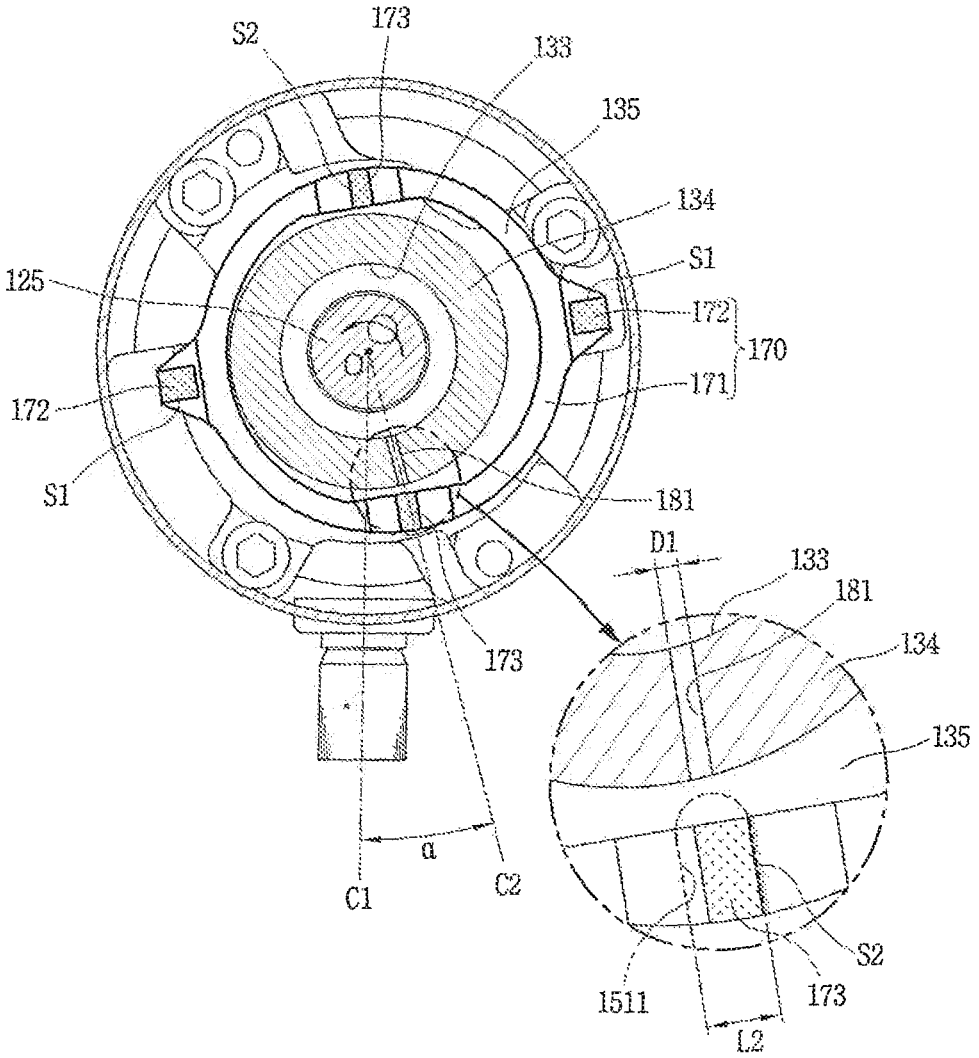
FIG. 6 is a horizontal cross-sectional view illustrating a positional relationship between a refrigerant suction pipe and the oil supply passage in FIG. 3.
Figure 7:
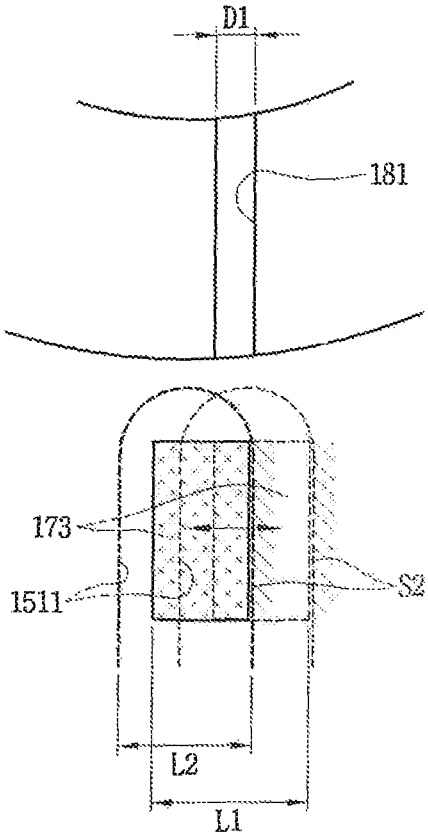
FIG. 7 is a schematic view illustrating a position of the oil supply passage in FIG. 6.

FIG. 4 is an enlarged perspective view illustrating a surrounding of an oil supply passage in FIG. 3. FIG. 5 is an enlarged cross-sectional view illustrating the surrounding of the oil supply passage in FIG. 3. FIG. 6 is a horizontal cross-sectional view illustrating a positional relationship between the refrigerant suction pipe and the oil supply passage in FIG. 3, and FIG. 7 is a schematic view illustrating a position of the oil supply passage in FIG. 6.

Referring back to FIG. 3, the main frame 130 may include the orbiting space 133 formed in the center of the upper surface, the scroll support 134 formed in the annular shape along the circumference of the orbiting space 133, and the Oldham ring support 135 formed in the annular shape at an outer side of the scroll support 134 to surround the scroll support 134. As the Oldham ring support 135 is stepped downward by a preset or predetermined depth from the outer circumferential side of the scroll support 134, an inner circumferential surface of the Oldham ring support 135 may also be defined as an outer circumferential surface of the scroll support 134.

Referring to FIGS. 4 and 5, the first oil supply passage 181 may be disposed in the orbiting space 133 according to this embodiment. For example, the first oil supply passage 181 may be configured such that a first end 1811 defining an inlet and a second end 1812 defining an outlet communicate with each other. The first end 1811 may communicate with the orbiting space 133 disposed in a central portion of the main frame 130 and the second end 1812 may communicate with the Oldham ring support 135. Accordingly, the orbiting space 133 may directly communicate with the Oldham ring support 135 through the first oil supply passage 181.

More specifically, the first end 1811 of the first oil supply passage 181 may be open toward the inner circumferential surface of the orbiting space 133 and the second end 1812 of the first oil supply passage 181 may be open toward the outer circumferential surface of the orbiting space 133 (or the inner circumferential surface of the Oldham ring support 135). Accordingly, the first end 1811 of the first oil supply passage 181 may be open toward the outer circumferential surface of the rotational shaft 125 and the second end 1812 of the first oil supply passage 181 may be open toward the inner circumferential surface of the Oldham ring 170.

Referring to FIG. 6, the first oil supply passage 181 may be disposed as close to the refrigerant suction pipe 117 as possible. For example, the first oil supply passage 181 may be formed within a range of approximately ±10° from the refrigerant suction pipe 117 in the circumferential direction.

In other words, when an imaginary line passing through a center of the refrigerant suction pipe 117 from an axial center O of the rotational shaft 125 is called a first radial center line C1 and an imaginary line passing through a center of the first oil supply passage 181 from the axial center O of the rotational shaft 125 is a second radial center line C2, an oil supply passage central angle $\alpha$ defined as a central angle between the first radial center line C1 and the second radial center line C2 may be approximately ±10°. Accordingly, even though the oil is swept away by the suctioned refrigerant on the second sliding surface S2 between the key (e.g., the second key) 173 and the key groove, for example, the second key groove 1511, which are adjacent to the refrigerant suction pipe 117, oil may be supplied to the second sliding surface S2 rapidly and smoothly, resulting in effectively preventing wear on the second sliding surface S2.

In this case, a lubrication effect may be improved even on the first sliding surface S1 between the first key 172 and the first key groove 1441 adjacent to the refrigerant suction pipe 117. In other words, when the first key 172 and the second key 173 extend in the same axial direction, the first key 172 may be relatively higher than the second key 173 in view of height, but when a large amount of oil is supplied to the orbiting space 133 through the first oil supply passage 181, an amount of oil scattered due to the reciprocating motion of the Oldham ring 170 may increase, thereby increasing an amount of oil to be supplied to the first key 172 (or the first key groove). Accordingly, even when the first key 172 and the second key 173 extend in the same axial direction, more oil may be supplied to the first key 172 (or first key groove) and the second key 173 (or the second key groove), so as to effectively lubricate each sliding surface S1 and S2.

Referring to FIG. 7, the first oil supply passage 181 may be formed such that at least a portion thereof is located within a reciprocating distance L1 of the second key 173 adjacent to the first oil supply passage 181. With respect to the second key 173 as a reference, the reciprocating distance L1 may be defined as a distance between a maximum movement position of one circumferential side surface of the second key 173 and a maximum movement position of another circumferential side surface of the second key 173 during the reciprocating motion of the second key 173.

For example, the first oil supply passage 181 may be formed inside of the scroll support 134 that supports the orbiting scroll 150, and thus, located lower than the second key 173 (or the second key groove) in the axial direction. When projected in the axial direction, at least a portion of the first oil supply passage 181 may be located within a range of the reciprocating distance L1 of the second key 173 that reciprocates together with the orbiting scroll 150. Accordingly, the first oil supply passage 181 may be always located adjacent to the second sliding surface S2 between the second key 173 and the second key groove 1511. This may allow the oil introduced into the Oldham ring support 135 through the first oil supply passage 181 to be rapidly and smoothly supplied to the second sliding surface S2 between the second key 173 and the second key groove 1511 which are adjacent to the refrigerant suction pipe 117, even though the first oil supply passage 181 does not communicate directly with the second key groove 1511 in the radial direction.

In addition, the first oil supply passage 181 may be configured as a hole that penetrates through the inside of the main frame 130. For example, an axial bearing surface 1341 constituting an upper surface of the scroll support 134 may be formed to be flat, and the first oil supply passage 181 may radially penetrate through between the inner and outer circumferential surfaces of the scroll support 134 (the inner circumferential surface of the scroll support 134 and the inner circumferential surface of the Oldham ring support 135). Accordingly, the entire axial bearing surface 1341 of the scroll support 134 may define a bearing surface without exception, thereby securing an area of the axial bearing surface 1341. Also, a partial increase in surface pressure with respect to the orbiting scroll 150 may be prevented, thereby preventing wear of the main frame 130 or the orbiting scroll 150.

More specifically, the first oil supply passage 181 may penetrate through the scroll support 134 in an upper half portion of the orbiting space 133 in the radial direction, precisely, in a direction orthogonal to the axial direction of the rotational shaft 125, so as to communicate with the Oldham ring support 135. Accordingly, the first oil supply passage 181 may have a shortest length, processing of the first oil supply passage 181 may be facilitated, and oil of the orbiting space 133 may be quickly moved to the Oldham ring support 135. However, the first oil supply passage 181 may alternatively be configured as a recess recessed in the axial bearing surface 1341 of the main frame 130, or may be configured as a hole in a manner that the first end 1811 of the first oil supply passage 181 is inclined downward. These will be described hereinafter in different embodiments for the first oil supply passage.

In addition, the first oil supply passage 181 may have a same inner diameter between both ends thereof. Accordingly, a pressure or speed of the oil flowing into the first key groove 1441 may be constantly maintained. However, in some cases, the first oil supply passage 181 may be formed such that the inner diameter between both ends differs, for example, the first end 1811 of the first oil supply passage 181 is wider than the second end 1812 of the first oil supply passage 181. Accordingly, the oil may be smoothly introduced into the Oldham ring support 135 and supplied to the first key groove 1441 more quickly.

In addition, the first oil supply passage 181 may be formed in a circular shape, for example. However, the first oil supply passage 181 may alternatively be formed in an oval or slit shape. When the first oil supply passage 181 is formed in an oval or slit shape, an area of the first oil supply passage 181 may be enlarged to increase an oil flow rate even though the height of the scroll support 134 from the Oldham ring 135 is low.

Referring to FIGS. 6 and 7, the first oil supply passage 181 according to this embodiment may be smaller than or equal to a widthwise length of the radial inner surface of the adjacent second key groove 1511 (or the radial inner surface of the second key), in other words, an inner diameter D1 of the second end 1812 of the first oil supply passage 181 may be smaller than or equal to a widthwise length L2 of a radial inner surface 1511*a* of the second key groove 1511. In general, when the oil supply passage is formed between the orbiting space 133 and the Oldham ring support 135 as in this embodiment, some of the oil contained in the orbiting space 133 may move directly to the Oldham ring support 135 through the oil supply passage 181, 182. Accordingly, an amount of oil moved to the Oldham ring support 135 may increase but an amount of oil to be stored in the orbiting space 133 may decrease conversely.

At this time, the oil moving to the Oldham ring support 135 may be swept away by the refrigerant suctioned through the refrigerant suction pipe 117 to be introduced into the compression chamber V and then discharged together with the refrigerant outside of the compressor. In this case, an amount of oil discharged from the inside of the compressor may excessively increase. This may aggravate friction loss or wear due to oil shortage in the compressor, namely, in the casing 110.

Accordingly, in this embodiment, an inner diameter of the first oil supply passage 181 may be appropriately limited to prevent an excessive increase in the amount of oil discharged out of the compressor. For example, the inner diameter of the first oil supply passage 181, precisely, inner diameter D1 of the second end 1812 may be smaller than or equal to half of a widthwise length L2 of the radial inner surface 1511*a* of the second key groove 111, for example, may be in the range of 2 to 3 mm. Accordingly, an oil circulation ratio may be appropriately limited by preventing the oil in the orbiting space 133 from excessively flowing into the Oldham ring support 135 or the second key groove 1511, thereby preventing oil shortage in the compressor in advance.

Figure 8:
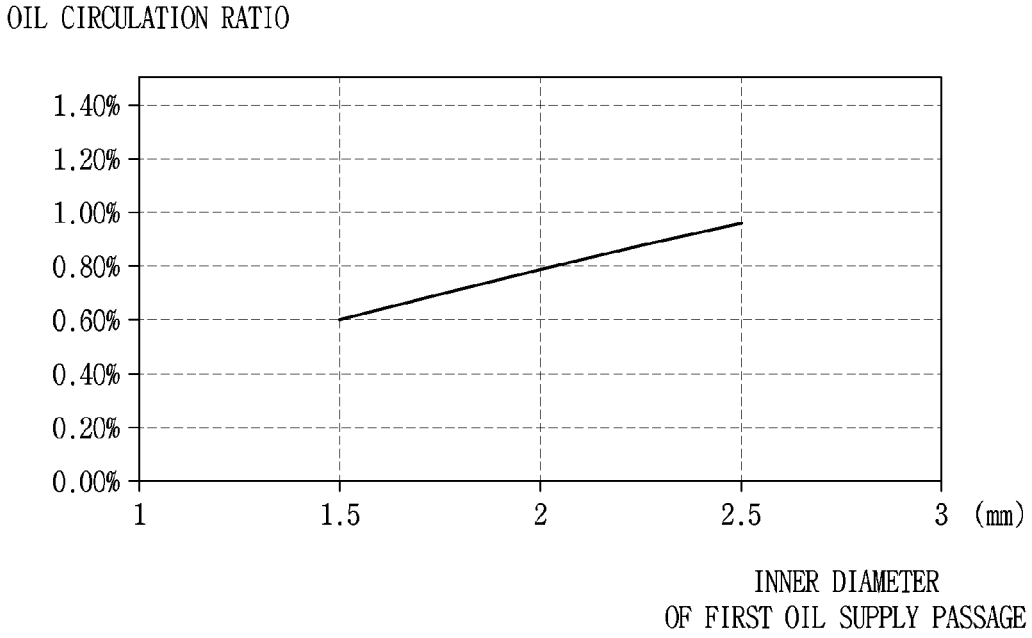
FIG. 8 is a graph comparing an oil circulation ratio with respect to a size of an oil supply passage according to an embodiment.

FIG. 8 is a graph comparing an oil circulation ratio with respect to a size of an oil supply passage according to an embodiment. FIG. 8 illustrates a change in an oil circulation ratio according to a change in the inner diameter of the first oil supply passage 181. Referring to FIG. 8, the oil circulation ratio may be about 0.6% when the inner diameter of the first oil supply passage 181 is about 1.5 mm, whereas the oil circulation ratio is about 1.00% when the inner diameter is about 2.5 mm. Considering that an oil circulation ratio is typically managed to be less than 1.00% in the scroll compressor, the inner diameter D1 of the first oil supply passage 181 may be smaller than or equal to about 3 mm in consideration of processing errors or oil viscosity.

In other words, referring to the graph of FIG. 8, in order to lower the oil circulation ratio, it may be advantageous to set the inner diameter D1 of the first oil supply passage 181 as small as possible. However, if the inner diameter D1 of the first oil supply passage 181 is too small, an amount of oil flowing into the second key groove 1511 adjacent to the first oil supply passage 181 may be greatly reduced, and thereby substantial friction loss and wear may not be prevented. Therefore, in consideration of the lubrication effect and the oil circulation ratio in the second key groove 1511, the inner diameter D1 of the first oil supply passage 181 may be set to about 2 to 3 mm.

In the scroll compressor according to this embodiment, the oil introduced into the orbiting space 133 through the oil passage 125*b* of the rotational shaft 125 may move toward the Oldham ring support 135 located at the outer side of the scroll support 134 through the first oil supply passage 181. In the Oldham ring support 135, the oil introduced across the scroll support 134 may be merged with oil introduced directly through the first oil supply passage 181, thereby securing a large amount of oil. Accordingly, even if oil inside of or around the second key groove 1511 which is adjacent to the first oil supply passage 181 is swept away by the refrigerant suctioned through the refrigerant suction pipe 1117, some of oil stored in the Oldham ring support 135 may be scattered during the reciprocating motion of the Oldham ring 170 so as to be continuously replenished into the second key groove 1511.

In this way, even if the refrigerant suctioned through the refrigerant suction pipe scatters the oil, which lubricates the sliding surface while passing through a gap between the key and the key groove adjacent to the refrigerant suction pipe, oil may be quickly and smoothly supplied into the gap between the key and the key groove through the oil supply passage. Accordingly, the oil may effectively lubricate the sliding surface between the key and the key groove, thereby preventing wear of the sliding surface of the key or the sliding surface of the key groove facing the key. This may stabilize the behavior of the orbiting scroll, so as to prevent friction loss between the orbiting scroll and members in contact with the orbiting scroll and leakage between the compression chambers, thereby improving compressor efficiency.

In addition, by optimizing the position and size of the oil supply passage, a sufficient amount of oil may be provided between the key of the Oldham ring 170 and the key groove into which the key of the Oldham ring 170 is inserted and simultaneously an increase in the oil circulation ratio of the compressor may be prevented. The decrease in friction loss in the compressor may result in further enhancing compressor efficiency. In addition, the refrigerant suctioned into the low-pressure portion through the refrigerant suction pipe may be prevented from sweeping away the oil in a vicinity of the Oldham ring and some of the refrigerant may be allowed to move toward the drive motor so as to cool down the drive motor, thereby enhancing motor efficiency.

Hereinafter, description will be given of an oil supply passage according to another embodiment. That is, in the previous embodiment, the first oil supply passage is formed in a direction orthogonal to the axial direction, but in some cases, the first oil supply passage may be formed to be inclined with respect to the axial direction.

Figure 9:
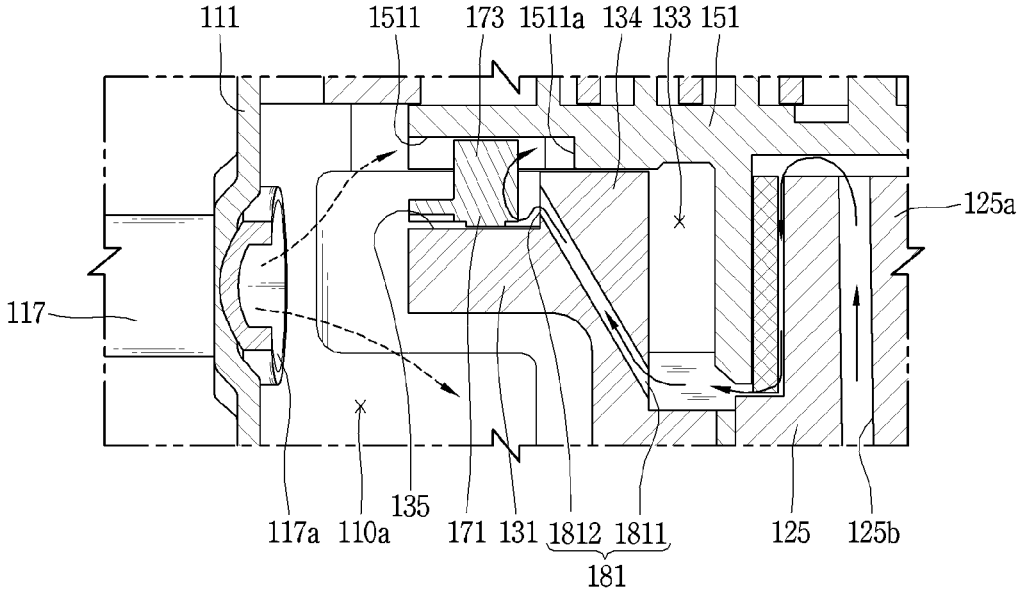
FIG. 9 is a cross-sectional view of an oil supply passage according to another embodiment.

FIG. 9 is a cross-sectional view of an oil supply passage according to another embodiment. Referring to FIG. 9, first oil supply passage 181 according to this embodiment may be formed through a section between the orbiting space 133 and the Oldham ring support 135. For example, first end 1811 of the first oil supply passage 181 may be open toward the inner circumferential surface of the orbiting space 133 and second end 1812 of the first oil supply passage 181 may be open toward the outer circumferential surface of the scroll support 134, that is, the inner circumferential surface of the Oldham ring support 135. Accordingly, the oil of the orbiting space 133 may be supplied to the Oldham ring support 135 through the first oil supply passage 181. The basic configuration of the first oil supply passage 181 according to this embodiment and effects thereof may be almost the same as those of the first oil supply passage 181 of the previous embodiment, and thus, repetitive description thereof has been omitted. However, the first oil supply passage 181 according to this embodiment may be inclined between the first end 1811 and the second end 1812. For example, the first end 1811 of the first oil supply passage 181 may be located to be lower than the second end 1812.

In other words, the first end 1811 of the first oil supply passage 181 may be open at a position which is lower than a position of the Oldham ring support 135, for example, a position adjacent to a bottom surface of the orbiting space 133. Accordingly, even if a flow rate of oil filled in the orbiting space 133 is low, that is, namely, at the time when the compressor is turned on and oil starts to be filled in the orbiting space 133 or in a short time thereafter, the oil of the orbiting space 133 may be quickly supplied to the Oldham ring support 135 through the first oil supply passage 181. This may prevent wear due to oil shortage on the sliding surface S1, S2, which may occur just after starting the compressor, thereby enhancing compressor efficiency.

Hereinafter, description will be given of an oil supply passage according to still another embodiment. That is, in the previous embodiments, the first oil supply passage is be formed in the shape of a hole, but in some cases, the first oil supply passage may alternatively be formed in the shape of a recess.

Figure 10:
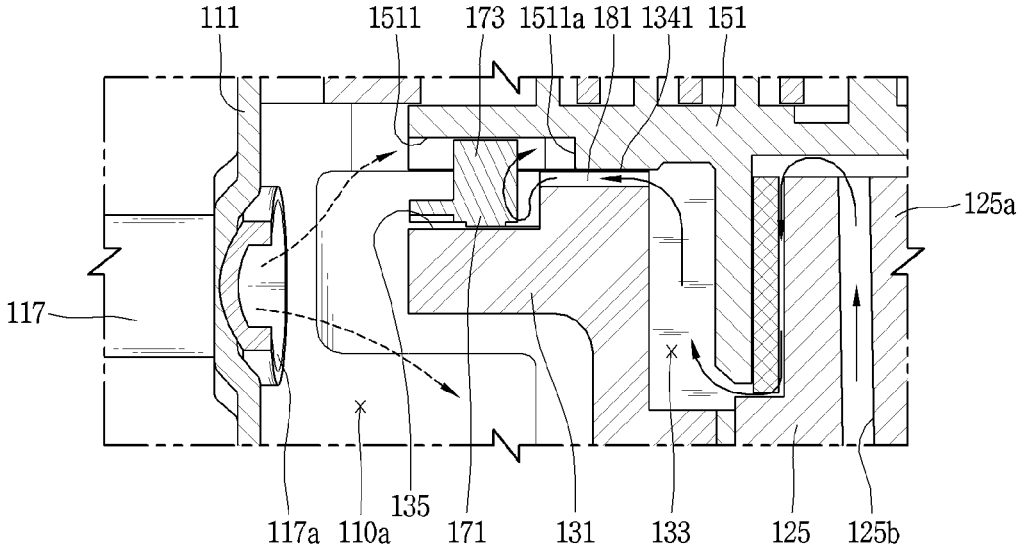
FIG. 10 is a cross-sectional view of an oil supply passage according to still another embodiment.

FIG. 10 is a cross-sectional view of an oil supply passage according to still another embodiment. Referring to FIG. 10, first oil supply passage 181 according to this embodiment may be recessed by a preset or predetermined depth into an upper surface of scroll support 134, namely, into axial bearing surface 1341 supporting orbiting scroll 150 in the axial direction. Even in this case, the basic configuration of the first oil supply passage 181 according to this embodiment and effects thereof may be the same/like as those of the previous embodiment, and thus, repetitive description thereof has been omitted.

However, as described above, the first oil supply passage 181 according to this embodiment may be recessed into the upper surface of the scroll support 134, namely, into the axial bearing surface 1341, which may facilitate the processing of the first oil supply passage 181. In addition, as the first oil supply passage 181 is formed to be recessed, a space may be defined between the upper surface of the scroll support 134 constituting the axial bearing surface 1341 and a lower surface of orbiting end plate 151 facing it. Accordingly, the oil in the orbiting space 133 may be quickly and continuously supplied to the axial bearing surface 1341 through the first oil supply passage 181, to smoothly lubricate the portion between the main frame 130 and the orbiting scroll 150. This can reduce the friction loss between main frame 130 and the orbiting scroll 150 so as to enhance compressor efficiency.

Hereinafter, description will be given of an oil supply passage according to still another embodiment. That is, in the previous embodiments, the oil supply passage is formed in the main frame, but the oil supply passage may alternatively be formed in the orbiting scroll.

Figure 11:
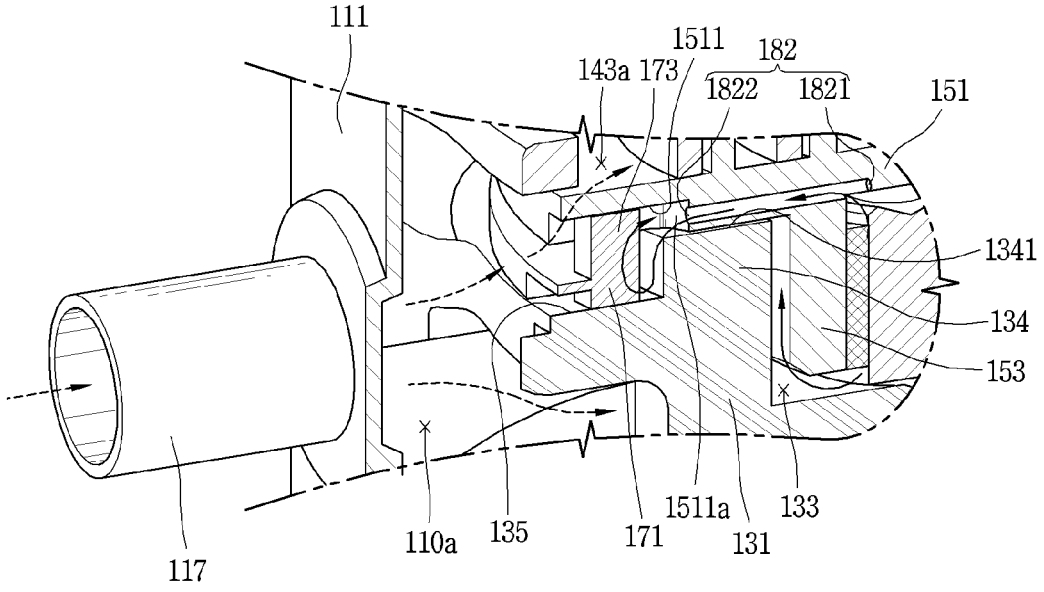
FIGS. 11 and 12 are a planar view and a cross-sectional view of an oil supply passage according to still another embodiment.
Figure 12:
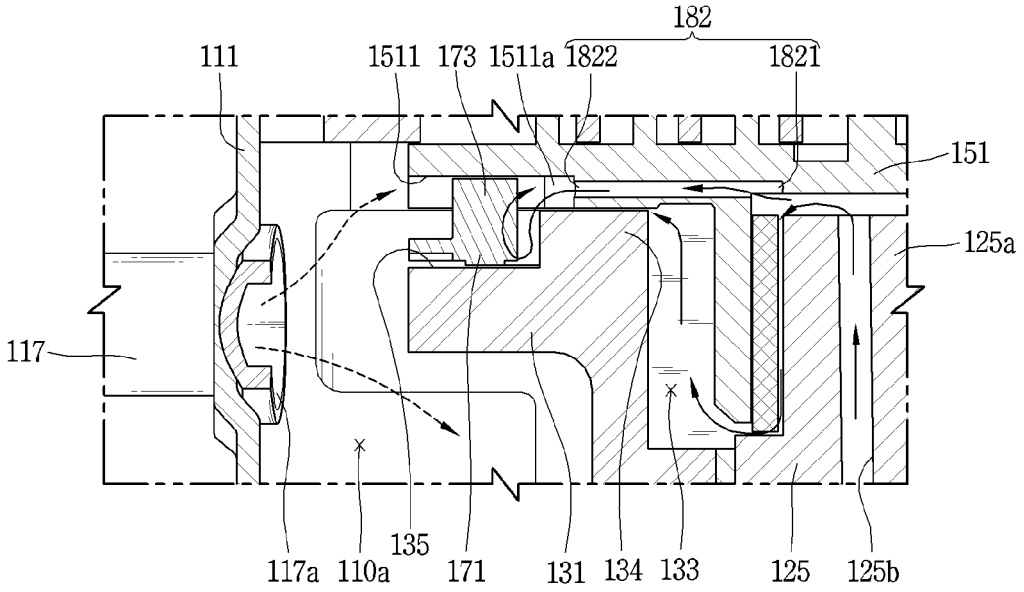
Figure 13:
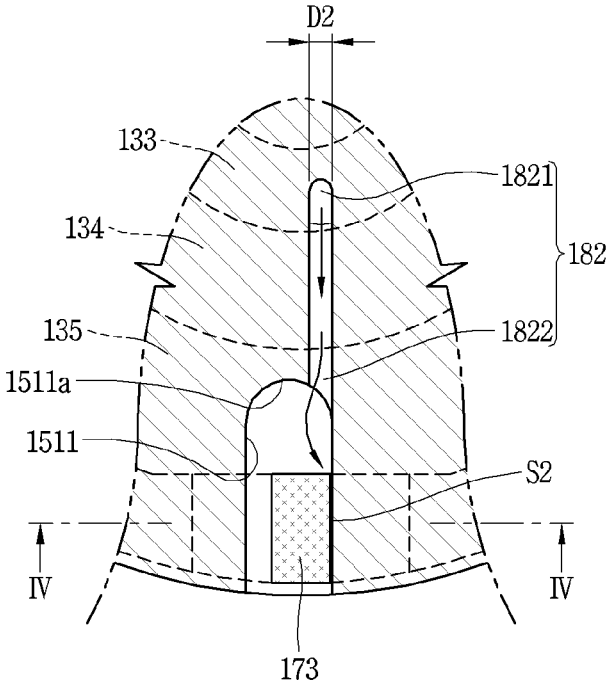
FIG. 13 is a horizontal cross-sectional view of the oil supply passage according to FIG. 11.
Figure 14:
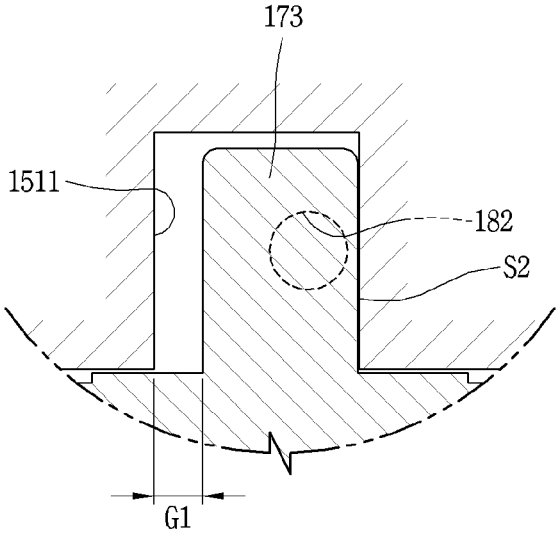
FIG. 14 is a cross-sectional view, taken along line "XIV-XIV" of FIG. 13.

FIGS. 11 and 12 are a planar view and a cross-sectional view of an oil supply passage according to still another embodiment. FIG. 13 is a horizontal cross-sectional view of the oil supply passage of FIG. 11. FIG. 14 is a cross-sectional view, taken along line "XIV-XIV" of FIG. 13.

Referring to FIGS. 11 and 12, orbiting scroll 150 according to this embodiment may include orbiting end plate 151, orbiting wrap 152, and rotational shaft coupling portion 153. The basic configuration of the orbiting end plate 151, the orbiting wrap 152, and the rotational shaft coupling portion 153 and effects thereof may be almost the same as those of the previous embodiments. However, the orbiting end plate 151 according to this embodiment may include a second oil supply passage 182, which may communicate with a radial inner surface of the second key groove 1511.

The second oil supply passage 182 according to this embodiment may be formed in the shape of a hole that penetrates through the inside of the orbiting scroll 150, that is, the orbiting end plate 151. For example, the second oil supply passage 182 may include first end 1821 and second end 1822 that communicates with each other. The first end 1821 may be open toward the orbiting space 133 and the second end 1822 may be open toward the radial inner surface of the second key groove 1511.

The second oil supply passage 182 may be formed in a horizontal direction orthogonal to the axial direction of rotational shaft 125 or may be formed in an inclined direction. However, as the orbiting end plate 151, through which the second oil supply passage 182 penetrates, is formed as thin as possible, it may be advantageous in terms of processing that the second oil supply passage 182 is formed in the horizontal direction rather than in the inclined direction.

More specifically, the second oil supply passage 182 may be formed in the horizontal direction in such a manner that the first end 1821 is open downwardly from the inside of the rotational shaft coupling portion 153 toward the orbiting space 133 and the second end 1822 is open radially from the radial inner surface 1511*a* of the second key groove 1511 toward the second key 173.

A shape of the second oil supply passage 182 may be similar to that of the first oil supply passage 181 described above. For example, an inner diameter D2 of the second oil supply passage 182 may be formed equally between both ends, but in some cases, an inner diameter of the first end 1821 and an inner diameter of the second end 1822 may be different from each other. For example, the inner diameter of the first end 1821 may be larger than the inner diameter of the second end 1822.

In addition, the second end 1822 of the second oil supply passage 182 may be formed at a center of the radial inner surface 1511*a* of the second key groove 1511. However, the second end 1822 of the second oil supply passage 182 may alternatively be formed to be eccentric from the center of the radial inner surface 1511*a* of the second key groove 1511 in the circumferential direction.

For example, referring to FIGS. 13 and 14, the second end 1822 of the second oil supply passage 182 may be eccentric toward the second sliding surface S2 at which the second key 173 and the second key groove 1511 are brought into contact with each other in the rotational direction of the rotational shaft 125. Accordingly, the second oil supply passage 182 may be closer to the second sliding surface S2, so that oil flowing into the second key groove 1511 through the second oil supply passage 182 may be supplied to the second sliding surface S2 more quickly and smoothly.

In addition, the inner diameter D2 of the second end 1822 of the second oil supply passage 182 may be smaller than or equal to a widthwise length 12 of the radial inner surface 1511*a* of the second key groove 1511, more specifically, smaller than half of the widthwise length L2 of the radial inner surface 1511*a* of the second key groove 1511 and larger than a maximum gap G1 between the second key groove 1511 and the second key 173. For example, the inner diameter D2 of the second end 1822 of the second oil supply passage 182 may be within 2 to 3 mm.

As described above, when the second oil supply passage 182 is formed in the orbiting scroll 150, the oil filled in the orbiting space 133 may be supplied directly to the second key groove 1511 through the second oil supply passage 182. Accordingly, the oil may be quickly and sufficiently supplied to the second key groove 1511 adjacent to the outlet 117*a* of the refrigerant suction pipe 117, so that the second sliding surface S2 between the second key groove 1511 and the second key 173 may be lubricated more effectively.

In addition, the second oil supply passage 182 according to this embodiment may supply the oil of the orbiting space 133 to the second key groove 1511 more quickly. That is, the oil of the casing 110 may be suctioned up through the oil passage 125*b* of the rotational shaft 125. This oil may first be filled in the inside of the rotational shaft coupling portion 153, discharged out of the rotational shaft coupling portion 153, and then filled in the outside of the orbiting space 133. At this time, as the first end 1821 of the second oil supply passage 182 is formed inside of the rotational shaft coupling portion 153, the oil filled in the inside of the rotational shaft coupling portion 153 may be quickly supplied to the second key groove 1511 before the oil is filled in the outside of the rotational shaft coupling portion 153. This may reduce friction loss and wear on the second sliding surface S2 when the compressor is started.

Hereinafter, description will be given of an oil supply passage according to still another embodiment. That is, in the previous embodiments, the oil supply passage is formed only between the orbiting space portion and the key groove, but in some cases, the oil supply passage may alternatively extend into the key groove.

Figure 15:
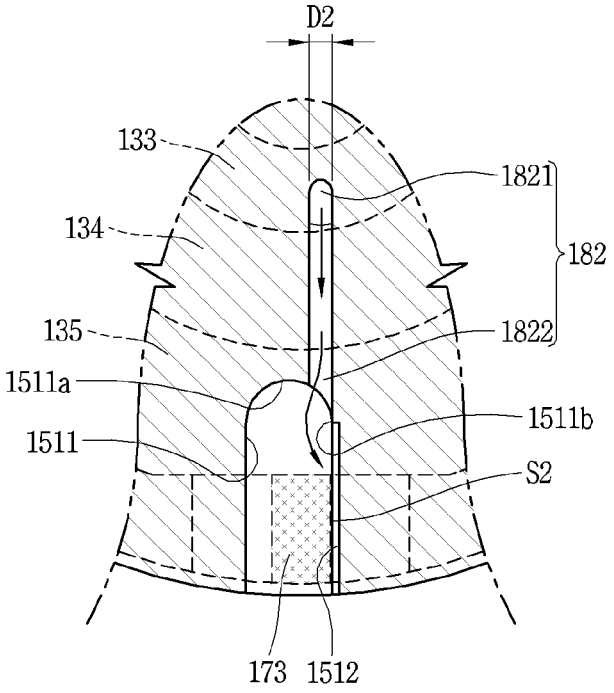
FIG. 15 is a horizontal cross-sectional view illustrating another embodiment of the oil supply passage according to FIG. 11.

FIG. 15 is a horizontal cross-sectional view of an oil supply passage according to still another embodiment. Referring to FIG. 15, first end 1821 of second oil supply passage 182 according to this embodiment may communicate with orbiting space 133 through a lower surface of orbiting end plate 151, and second end 1822 of the second oil supply passage 182 may be formed through radial inner surface 1511*a* of second key groove 1511. As the second oil supply passage 182 is configured the same/like as the embodiment illustrated in FIGS. 11 to 14, repetitive description thereof has been omitted.

However, an oil supply groove 1512 may further be formed in the second key groove 1511 according to this embodiment. For example, the oil supply groove 1512 may extend radially from one circumferential side surface of the second key groove 1511, that is, a circumferential inner surface 1511*b* constituting the first sliding surface.

One oil supply groove 1512 may be provided. The single oil supply groove 1512 may be formed at an intermediate height in the circumferential inner surface 1511*b* of the second key groove 1511. For example, an inner end of the oil supply groove 1512 may be located to be almost in contact with the radial inner surface 1511*a* of the first key groove 1441, so as to be almost connected to the second end 1822 of the second oil supply passage 182. Accordingly, the oil flowing into the second key groove 1511 through the second oil supply passage 182 may move quickly and continuously to the oil supply groove 1512.

Another or a second end of the oil supply groove 1512 may be closed. For example, the second end of the oil supply groove 1512 may be located radially inward than an outer circumferential end of the second key groove 1511. This may prevent the oil flowing into the oil supply groove 1512 from leaking out of the second key groove 1511, so as to prevent the oil from being discharged by the suctioned refrigerant.

However, the second end of the oil supply groove 1512 may extend up to the outer circumferential end of the second key groove 1511, as illustrated in FIG. 15. Accordingly, some of the oil flowing into the second key groove 1511 through the second oil supply passage 182 may be introduced into the oil supply groove 1512. The oil may be supplied to the second key groove 1511 while smoothly circulating along the oil supply groove 1512 with both ends open.

Although not illustrated in the drawings, a plurality of the oil supply groove 1512 may alternatively be provided. In this case, the plurality of oil supply grooves 1512 may be disposed at predetermined intervals in the axial direction. Accordingly, the oil may be evenly distributed in the axial direction to further enhance the lubricating effect on the second sliding surface S2.

Although not illustrated, the oil supply groove 1512 may be formed in one circumferential side surface (no reference numeral given) of the second key 173 constituting the second sliding surface S2 or may be formed in each of the one circumferential side surface of the second key 173 constituting the second sliding surface S2 and the circumferential inner surface 1511*b* of the second key groove 1511 facing it. As the basic configuration of this embodiment and effects thereof are similar to those of the previous embodiment, repetitive description thereof has been omitted.

Although not illustrated, the scroll compressor according to this embodiment may include both the first oil supply passage 181 and the second oil supply passage 182. In this case, as the first oil supply passage 181 and the second oil supply passage 182 are the same as the oil supply passages in the previous embodiments, repetitive description thereof has been omitted.

As described above, when the first oil supply passage 181 is formed in the main frame 130 and the second oil supply passage 182 is formed in the orbiting scroll 150, the oil filled in the orbiting space 133 may be supplied to the first key groove 1441 through the first oil supply passage 181 via the Oldham ring support 135 and to the second key groove 1511 through the second oil supply passage 182. Accordingly, even if the refrigerant suctioned through the refrigerant suction pipe 117 sweeps away the oil on the first sliding surface S1 and the second sliding surface S2, the oil inside of the orbiting space 133 may be continuously supplied to the first key groove 1441 and the second key groove 1511 through the first oil supply passage 181 and the second oil supply passage 182. Such oil may smoothly lubricate the first sliding surface S1 and the second sliding surface S2 so as to effectively prevent friction loss and wear on each sliding surface S1 and S2, thereby enhancing compressor efficiency.

On the other hand, the previous embodiment illustrates the example in which the first oil supply passage 181 is formed in the main frame 130 and the second oil supply passage 182 is formed in the orbiting scroll 150, but in some cases, only the first oil supply passage 181 may be formed in the main frame 130 or only the second oil supply passage 182 may be formed in the orbiting scroll 150. Even when only the first oil supply passage 181 is formed or only the second oil supply passage 182 is formed, the first oil supply passage 181 and the second oil supply passage 182 are the same/like as those in the previous embodiment. Thus, repetitive description thereof has been omitted. However, the refrigerant suction pipe 117 may be disposed adjacent to the first key groove 1441 when only the first oil supply passage 181 is formed whereas the refrigerant suction tube 117 may be disposed adjacent to the second key groove 1511 when only the second oil supply passage 182 is formed.

Hereinafter, description will be given of an oil supply passage according to still another embodiment. That is, the previous embodiment illustrates that the refrigerant suction pipe is eccentrically located to be closer to either one of the first key and the second key, but in some cases, the refrigerant suction pipe may be located approximately in the middle between the first key and the second key. This will be mainly described with reference to an example employing a bidirectional Oldham ring in which the first key and the second key constituting the Oldham ring extend in different axial directions.

Figure 16:
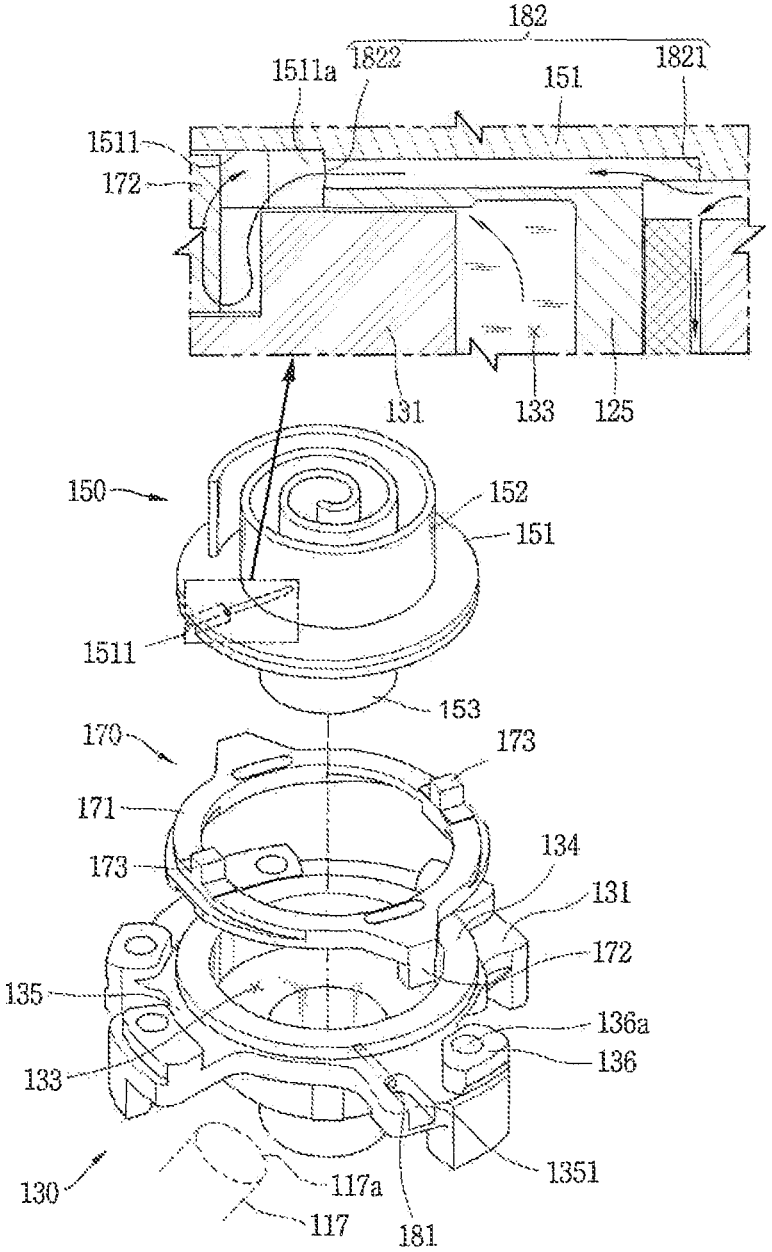
FIG. 16 is an exploded perspective view illustrating a portion of a compression unit employing a bidirectional Oldham ring in FIG. 1.
Figure 17:
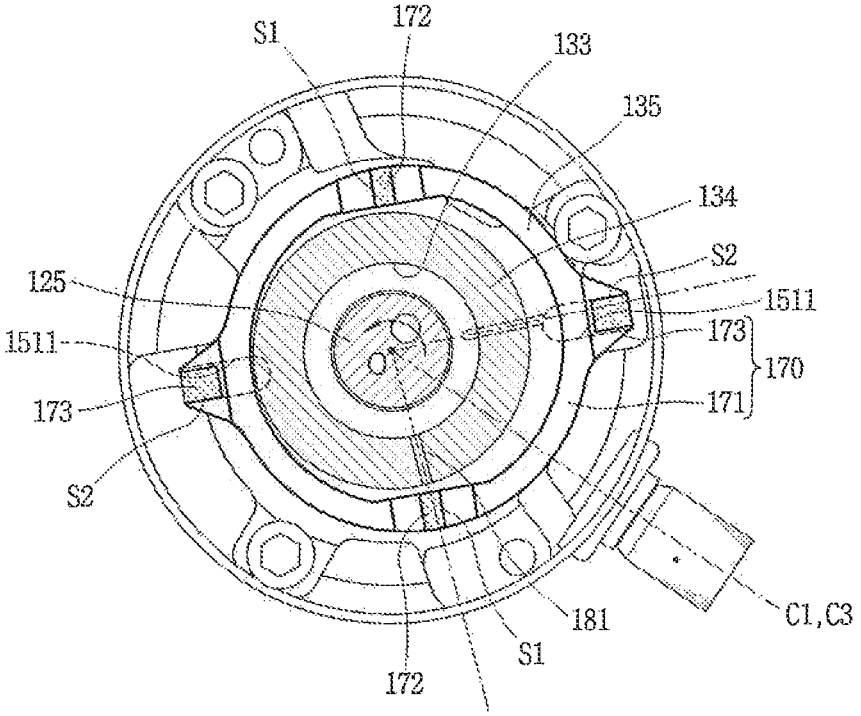
FIG. 17 is a horizontal cross-sectional view illustrating the assembled compression unit for explaining a positional relationship between a refrigerant suction pipe and the oil supply passage in FIG. 16.

FIG. 16 is an exploded perspective view illustrating a portion of a compression unit employing a bidirectional Oldham ring in FIG. 1. FIG. 17 is a horizontal cross-sectional view illustrating the assembled compression unit for explaining a positional relationship between a refrigerant suction pipe and the oil supply passage in FIG. 16.

Referring to FIGS. 16, and 17, according to this embodiment, first oil supply passage 181 may be formed in main frame 130 and second oil supply passage 182 may be formed in orbiting scroll 150. The basic configuration of the second oil supply passage 182 and operating effects thereof are the same/like those of the previous embodiments, so repetitive description thereof has been omitted.

However, first end 1811 of the first oil supply passage 181 according to this embodiment may penetrate through the inner circumferential surface of the orbiting space 133 and second end 1812 of the first oil supply passage 181 may penetrate through radial inner surface 1351*a* of first key groove 1351. In this case, the basic configuration of the first oil supply passage and operating effects thereof may be similar to those of the second oil supply passage 182 of the previous embodiments.

In addition, in the previous embodiments, the first oil supply passage 181 or the second oil supply passage 182 may be located at a position of about ±10° from the refrigerant suction pipe 117 in the circumferential direction, namely, disposed to be more adjacent to any one of the first key 172 and the second key 173. However, in this embodiment, at least a portion of the refrigerant suction pipe 117 may be located between the first key 172 (or first key groove) and the second key 173 (or second key groove) which are adjacent to each other in the circumferential direction. For example, when an imaginary line passing through the axial center O of the rotational shaft 125 and a middle position between the first key 172 (or first key groove) and the second key 173 (or second key groove) adjacent to each other is a third radial center line C3, at least a portion of the refrigerant suction pipe 117 may be located on the third radial center line C3. Accordingly, the refrigerant suction pipe 117 may be located at approximately a same distance from the first key 172 (or first key groove) and the second key 173 (or second key groove) in the circumferential direction.

In this way, when the refrigerant suction pipe 117 is located at the middle position between the first key 172 (or first key groove) and the second key 173 (or second key groove) in the circumferential direction, the first key 172 (or first key groove) or the second key 173 (or second key groove) may be located at a relatively far distance from the refrigerant suction pipe 117 in the circumferential direction. Accordingly, the first key 172 or the second key 173 may be located far away from influence of the refrigerant suctioned through the refrigerant suction pipe 117. This may minimize sweeping of the oil from the first sliding surface S1 or the second sliding surface S2 by the refrigerant suctioned through the refrigerant suction pipe 117, so as to reduce wear on the first sliding surface S1 and the second sliding surface S2.

In addition, the first oil supply passage 181 and the second oil supply passage 182 may communicate with the first key groove 1351 and the second key groove 1511, respectively, and may be located far from the refrigerant suction pipe 117. Accordingly, inner diameters of the first oil supply passage 181 and the second oil supply passage 182 may be further reduced. This may result in further decreasing the oil circulation ratio in the compressor.

The previous embodiment illustrates an example in which the first key 172 and the second key 173 of the Oldham ring 170 extend in the different axial directions, but embodiments may equally be applied to a case in which the first key 172 and the second key 173 of the Oldham ring 170 extend in the same axial direction.

As described above, when the first key 172 and the second key 173 extend in the same axial direction, the first key 172 may be relatively higher than the second key 173 in view of height, but when a large amount of oil is supplied to the orbiting space 133 through the oil supply passage 181, an amount of oil scattered due to the reciprocating motion of the Oldham ring 170 may increase, thereby increasing an amount of oil to be supplied to the first key 172 (or the first key groove). Accordingly, when the first key 172 and the second key 173 extend in the same axial direction, the amount of oil to be supplied to the second key 173 (or second key groove) as well as the first key 172 (or first key groove) may increase even if the refrigerant suction pipe 117 is located at the middle position between the first key 172 and the second key 173.

Embodiments disclosed herein provide a scroll compressor capable of preventing friction loss and wear between a key of an Oldham ring and a key groove into which the key of the Oldham ring is slidably inserted. Embodiments disclosed herein further provide a scroll compressor capable of smoothly and rapidly supplying oil between a key of an Oldham ring and a key groove into which the key of the Oldham ring is slidably inserted. Embodiments disclosed herein furthermore provide a scroll compressor capable of supplying oil directly into a key groove into which a key of an Oldham ring is inserted, so that oil may be smoothly and quickly supplied to a sliding surface between the key and the key groove.

Embodiments disclosed herein provide a scroll compressor capable of preventing an increase in an oil circulation ratio while securing sufficient oil between a key of an Oldham ring and a key groove into which the key of the Oldham ring is inserted. Embodiments disclosed herein also provide a scroll compressor capable of supplying oil directly into a key groove into which a key of an Oldham ring is inserted and capable of appropriately limiting the amount of oil to be supplied.

Embodiments disclosed herein provide a scroll compressor capable of rapidly and continuously supplying oil onto a sliding surface between a key of an Oldham ring and a key groove into which the key is inserted while minimizing an inner diameter of a passage for supplying the oil into the key groove. Embodiments disclosed herein additionally provide a scroll compressor capable of preventing wear between a key of an Oldham ring and a key groove into which the key is slidably inserted while refrigerant suctioned into a low-pressure portion cools down a drive motor appropriately.

Embodiments disclosed herein provide a scroll compressor capable of preventing refrigerant suctioned into a low-pressure portion from sweeping away oil between a key of an Oldham ring and a key groove. Embodiments disclosed herein also provide a scroll compressor capable of suppressing oil between a key and a key groove from being swept away by suction refrigerant by disposing a sliding surface between the key and the key groove at a position far away from a refrigerant suction pipe.

Embodiments disclosed herein provide a scroll compressor that may include a casing, a refrigerant suction pipe, a drive motor, an orbiting scroll, a non-orbiting scroll, a main frame, and an Oldham ring. The casing may have an inner space, which may be divided into a low-pressure part or portion and a high-pressure part or portion. The refrigerant suction pipe may communicate with the low-pressure part through the casing. The drive motor may be disposed in the low-pressure part of the casing. The orbiting scroll may be coupled to the drive motor through a rotational shaft to perform an orbiting motion. The non-orbiting scroll may be engaged with the orbiting scroll to form a compression chamber, and have a suction port formed through an outer circumferential surface thereof to communicate with the compression chamber. The main frame may be disposed in the low-pressure portion to support the orbiting scroll. The Oldham ring may be disposed between the main frame and the orbiting scroll. The main frame may include an orbiting space portion, a scroll support portion, and an oil supply passage. A rotational shaft coupling portion of the orbiting scroll to which the rotational shaft is coupled may be rotatably inserted into the orbiting space portion. The scroll support portion may be disposed to surround the orbiting space portion. One or a first end of the oil supply passage may be open to communicate with the orbiting space portion and another or a second end may be open to communicate with the Oldham ring. With this configuration, even if refrigerant suctioned through a refrigerant suction pipe sweeps away oil, which lubricates a sliding surface between a key and a key groove adjacent to the refrigerant suction pipe while passing through between the key and the key groove, oil may be quickly and smoothly supplied to the sliding surface. This may prevent wear between the key and the key groove so as to enhance efficiency of the compressor.

The Oldham ring may include a ring body, a first key, and a second key. The ring body may be formed in an annular shape. The first key may extend from one axial side surface of the ring body toward a first key groove disposed in the non-orbiting scroll. The second key may extend from the one axial side surface of the ring body toward a second key groove disposed in the orbiting scroll. At least a portion of the oil supply passage may be located within a reciprocating distance of the second key. With this configuration, oil may be smoothly and quickly supplied to the second key groove as the oil supply passage is arranged adjacent to the second key groove.

More specifically, the oil supply passage may pass through an inside of the scroll support portion in a direction orthogonal to the axial direction of the rotational shaft. This may minimize a length of the oil supply passage.

Also, the oil supply passage may penetrate through the inside of the scroll support portion and the one end of the oil supply passage may be inclined downwardly toward the orbiting space portion. This may allow oil to be quickly supplied to a gap between the key and the key groove even when the compressor starts.

In addition, the oil supply passage may be recessed into an axial bearing surface of the scroll support portion in contact with the orbiting scroll. This may allow oil to more effectively lubricate a gap between the orbiting scroll and the scroll support portion.

The Oldham ring may include a ring body, a first key, and a second key. The ring body may be formed in an annular shape. The first key may extend from one axial side surface of the ring body toward a first key groove disposed in the main frame. The second key may extend from the one axial side surface of the ring body toward a second key groove disposed in the orbiting scroll. The oil supply passage may penetrate through the main frame such that the another end communicates with a radial inner surface of the first key groove. Accordingly, oil may be supplied directly to the first key groove to further increase a lubrication effect.

More specifically, the another end may be eccentrically formed on a radial inner surface of the first key groove in a rotational direction of the rotational shaft. This may allow oil to be quickly supplied to a substantial sliding surface between the key and the key groove. In addition, the oil supply passage may be formed in a direction orthogonal to the axial direction of the rotational shaft. The oil supply passage may also have the one end inclined downwardly toward the orbiting space portion.

The oil supply passage may pass through an end plate of the orbiting scroll, such that the another end may be disposed in the orbiting scroll to communicate with an inner surface of a key groove slidably coupled to the Oldham ring. Accordingly, oil may be more quickly supplied to the key groove.

More specifically, the one end may communicate with the inside of the rotational shaft coupling portion. Accordingly, oil may be more quickly supplied to the key groove. Also, the another end may be eccentrically formed on a radial inner surface of the key groove in a rotational direction of the rotational shaft.

The non-orbiting scroll or the main frame may be provided with a first key groove, and the orbiting scroll may be provided with a second key groove. The Oldham ring may be provided with a first key inserted into the first key groove, and a second key inserted into the second key groove. An oil supply groove may further be provided in at least one of one circumferential surface of the first key groove and one circumferential surface of the first key facing the first key groove or one circumferential surface of the second key groove and one circumferential surface of the second key facing the second key groove. This may increase an amount of oil supplied to the sliding surface or an amount of oil stored, thereby further enhancing the lubrication effect.

Embodiments disclosed herein provide a scroll compressor that may include a casing, a refrigerant suction pipe, a drive motor, an orbiting scroll, a non-orbiting scroll, a main frame, and an Oldham ring. The casing may have an inner space, which may be divided into a low-pressure part or portion and a high-pressure portion. The refrigerant suction pipe may communicate with the low-pressure part through the casing. The drive motor may be disposed in the low-pressure part of the casing. The orbiting scroll may be coupled to the drive motor through a rotational shaft to perform an orbiting motion. The non-orbiting scroll may be engaged with the orbiting scroll to form a compression chamber, and have a suction port formed through an outer circumferential surface thereof to communicate with the compression chamber. The main frame may be disposed in the low-pressure portion to support the orbiting scroll. The Oldham ring may be disposed between the main frame and the orbiting scroll. The main frame may include an orbiting space portion and a scroll support portion. A rotational shaft coupling portion of the orbiting scroll to which the rotational shaft is coupled may be rotatably inserted into the orbiting space portion. The scroll support portion may be disposed to surround the orbiting space portion. The orbiting scroll may include a key groove slidably coupled to the Oldham ring, and an oil supply passage formed in a radial inner surface of the key groove to communicate with the orbiting space portion. With this configuration, oil may be supplied directly to the key groove of the orbiting scroll. Accordingly, friction loss or wear may be prevented between the key groove of the orbiting scroll and the key inserted into the key groove even if oil is swept away during a suction process of refrigerant.

The one end of the oil supply passage may communicate with an inside of the rotational shaft coupling portion. The another end of the oil supply passage may be eccentrically formed on a radial inner surface of the key groove in a rotational direction of the rotational shaft.

The non-orbiting scroll or the main frame may be provided with a first key groove, and the orbiting scroll may be provided with a second key groove. The Oldham ring may be provided with a first key inserted into the first key groove, and a second key inserted into the second key groove. An oil supply groove may further be provided in at least one of one circumferential surface of the first key groove and one circumferential surface of the first key facing the first key groove or one circumferential surface of the second key groove and one circumferential surface of the second key facing the second key groove.

An inner diameter of the oil supply passage may be shorter than or equal to half of a widthwise length of the key groove into which the key of the Oldham ring is slidably inserted. Accordingly, an appropriate amount of oil may be supplied to the sliding surface between the key and the key groove, the sliding surface may be effectively lubricated, and also an increase in an oil circulation ratio inside of the compressor may be prevented, thereby enhancing compressor efficiency.

In addition, the oil supply passage may be formed within a range of ±10° from the refrigerant suction pipe in a circumferential direction. With this configuration, even if the sliding surface between the key and the key groove is adjacent to the refrigerant suction pipe, oil may be quickly supplied to the sliding surface, thereby effectively preventing wear.

In addition, the Oldham ring may have a plurality of keys disposed in a circumferential direction. At least a portion of the refrigerant suction pipe may be located on a center line between two keys adjacent to each other in the circumferential direction among the plurality of keys. This can allow the sliding surface between the key and the key groove to be located as far as possible from the refrigerant suction pipe, so as to prevent in advance oil shortage on the sliding surface due to refrigerant suctioned through the refrigerant suction pipe.

It will be understood that when an element or layer is referred to as being "on" another element or layer, the element or layer can be directly on another element or layer or intervening elements or layers. In contrast, when an element is referred to as being "directly on" another element or layer, there are no intervening elements or layers present. As used herein, the term "and/or" includes any and all combinations of one or more of the associated listed items.

It will be understood that, although the terms first, second, third, etc., may be used herein to describe various elements, components, regions, layers and/or sections, these elements, components, regions, layers and/or sections should not be limited by these terms. These terms are only used to distinguish one element, component, region, layer or section from another region, layer or section. Thus, a first element, component, region, layer or section could be termed a second element, component, region, layer or section without departing from the teachings of the present invention.

Spatially relative terms, such as "lower", "upper" and the like, may be used herein for ease of description to describe the relationship of one element or feature to another element (s) or feature(s) as illustrated in the figures. It will be understood that the spatially relative terms are intended to encompass different orientations of the device in use or operation, in addition to the orientation depicted in the figures. For example, if the device in the figures is turned over, elements described as "lower" relative to other elements or features would then be oriented "upper" relative to the other elements or features. Thus, the exemplary term "lower" can encompass both an orientation of above and below. The device may be otherwise oriented (rotated 90 degrees or at other orientations) and the spatially relative descriptors used herein interpreted accordingly.

The terminology used herein is for the purpose of describing particular embodiments only and is not intended to be limiting of the invention. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof.

Embodiments are described herein with reference to cross-section illustrations that are schematic illustrations of idealized embodiments (and intermediate structures). As such, variations from the shapes of the illustrations as a result, for example, of manufacturing techniques and/or tolerances, are to be expected. Thus, embodiments should not be construed as limited to the particular shapes of regions illustrated herein but are to include deviations in shapes that result, for example, from manufacturing.

Unless otherwise defined, all terms (including technical and scientific terms) used herein have the same meaning as commonly understood by one of ordinary skill in the art to which this invention belongs. It will be further understood that terms, such as those defined in commonly used dictionaries, should be interpreted as having a meaning that is consistent with their meaning in the context of the relevant art and will not be interpreted in an idealized or overly formal sense unless expressly so defined herein.

Any reference in this specification to "one embodiment," "an embodiment," "example embodiment," etc., means that a particular feature, structure, or characteristic described in connection with the embodiment is included in at least one embodiment. The appearances of such phrases in various places in the specification are not necessarily all referring to the same embodiment. Further, when a particular feature, structure, or characteristic is described in connection with any embodiment, it is submitted that it is within the purview of one skilled in the art to effect such feature, structure, or characteristic in connection with other ones of the embodiments.

Although embodiments have been described with reference to a number of illustrative embodiments thereof, it should be understood that numerous other modifications and embodiments can be devised by those skilled in the art that will fall within the spirit and scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

What is claimed is:

1. A scroll compressor, comprising:

a casing divided into a low-pressure portion and a high-pressure portion;

a refrigerant suction pipe that communicates with the low-pressure portion of the casing;

a drive motor disposed in the low-pressure portion of the casing;

an orbiting scroll coupled to the drive motor through a rotational shaft to perform an orbiting motion;

a non-orbiting scroll engaged with the orbiting scroll to form a compression chamber, and having a suction port formed through an outer circumferential surface thereof to communicate with the compression chamber;

a main frame disposed in the low-pressure portion to support the orbiting scroll; and an Oldham ring disposed between the main frame and the orbiting scroll, wherein the main frame comprises:

an orbiting space into which a rotational shaft coupling portion of the orbiting scroll coupled with the rotational shaft is rotatably inserted;

a scroll support that surrounds the orbiting space;

an Oldham ring support that surrounds the scroll support and communicates with the low-pressure portion; and an oil supply passage that passes through between an inner circumferential surface and an outer circumferential surface of the scroll support, and having a first end open to communicate with the orbiting space and a second end open to communicate with the Oldham ring, the oil supply passage penetrating through or being recessed on the scroll support, wherein the Oldham ring comprises:

a ring body formed in an annular shape;

a plurality of first keys that extends from a first axial side surface of the ring body toward a first key groove disposed in the non-orbiting scroll; and a plurality of second keys that extends from the first axial side surface of the ring body toward a second key groove disposed in the orbiting scroll, wherein at least a portion of the oil supply passage is located within a reciprocating distance of a key of the plurality of second keys that is closest to the refrigerant suction pipe in a circumferential direction, and wherein the at least the portion of the oil supply passage is located within a range of ±10° from the refrigerant suction pipe in the circumferential direction.

2. The scroll compressor of claim 1, wherein the oil supply passage penetrates through the scroll support in a direction orthogonal to an axial direction of the rotational shaft.

3. The scroll compressor of claim 1, wherein the oil supply passage penetrates through the scroll support and the first end of the oil supply passage is inclined downwardly toward the orbiting space.

4. The scroll compressor of claim 1, wherein the oil supply passage is recessed into an axial bearing surface of the scroll support in contact with the orbiting scroll.

5. The scroll compressor of claim 1, wherein an oil supply groove is provided in at least one of a circumferential surface of the first key groove and a circumferential surface of the first key that faces the first key groove or a circumferential surface of the second key groove and a circumferential surface of the second key that faces the second key groove.

6. The scroll compressor of claim 1, wherein the casing includes a cylindrical shell, an upper cap coupled to an open upper end of the cylindrical shell, and a lower cap coupled to a lower open end of the cylindrical shell.

7. The scroll compressor of claim 6, wherein a high/low pressure separation plate that divides the casing into the low-pressure portion and the high-pressure portion is fixed between the upper cap and the cylindrical shell.

8. The scroll compressor of claim 7, wherein the refrigerant suction pipe is coupled to an upper half portion of the cylindrical shell communicating with the low-pressure portion of the casing.

9. The scroll compressor of claim 7, wherein a refrigerant discharge pipe that communicates with the high-pressure portion of the shell is fixed to the upper cap above the high/low pressure separation plate.

10. A scroll compressor, comprising:

a casing divided into a low-pressure portion and a high-pressure portion;

a refrigerant suction pipe that communicates with the low-pressure portion of the casing;

a drive motor disposed in the low-pressure portion of the casing;

an orbiting scroll coupled to the drive motor through a rotational shaft to perform an orbiting motion;

a non-orbiting scroll engaged with the orbiting scroll to form a compression chamber, and having a suction port formed through an outer circumferential surface thereof to communicate with the compression chamber;

a main frame disposed in the low-pressure portion to support the orbiting scroll; and an Oldham ring disposed between the main frame and the orbiting scroll, wherein the main frame comprises:

an orbiting space into which a rotational shaft coupling portion of the orbiting scroll coupled with the rotational shaft is rotatably inserted;

a scroll support that surrounds the orbiting space;

an Oldham ring support that surrounds the scroll support and communicates with the low-pressure portion; and an oil supply passage that passes through between an inner circumferential surface and an outer circumferential surface of the scroll support, and having a first end open to communicate with the orbiting space and a second end open to communicate with the Oldham ring, the oil supply passage penetrating through or being recessed on the scroll support, wherein the Oldham ring comprises:

a ring body formed in an annular shape;

a plurality of first keys that extends from a first axial side surface of the ring body toward a first key groove disposed in the main frame; and a plurality of second keys that extends from a second axial side surface of the ring body toward a second key groove disposed in the orbiting scroll, wherein the oil supply passage penetrates through the main frame such that the second end of the oil supply passage communicates with a radial inner surface of the first key groove that is closest to the refrigerant suction pipe in a circumferential direction, and wherein at least a portion of the oil supply passage is located within a range of ±10° from the refrigerant suction pipe in a circumferential direction.

11. The scroll compressor of claim 10, wherein the second end is eccentric from the radial inner surface of the first key groove in a rotational direction of the rotational shaft.

12. The scroll compressor of claim 10, wherein the oil supply passage extends in a direction orthogonal to an axial direction of the rotational shaft.

13. The scroll compressor of claim 10, wherein the first end of the oil supply passage is inclined downwardly toward the orbiting space.

* * * * *